US012000108B2

(12) United States Patent
Iwasaki

(10) Patent No.: US 12,000,108 B2
(45) Date of Patent: Jun. 4, 2024

(54) CONTROL SYSTEM FOR CONSTRUCTION MACHINE, CONSTRUCTION MACHINE, AND CONTROL METHOD FOR CONSTRUCTION MACHINE

(71) Applicant: Komatsu Ltd., Tokyo (JP)

(72) Inventor: Yoshiro Iwasaki, Tokyo (JP)

(73) Assignee: Komatsu Ltd., Tokyo (JP)

( * ) Notice: Subject to any disclaimer, the term of this patent is extended or adjusted under 35 U.S.C. 154(b) by 408 days.

(21) Appl. No.: 17/419,850

(22) PCT Filed: Dec. 19, 2019

(86) PCT No.: PCT/JP2019/049873
§ 371 (c)(1),
(2) Date: Jun. 30, 2021

(87) PCT Pub. No.: WO2020/158234
PCT Pub. Date: Aug. 6, 2020

(65) Prior Publication Data

US 2022/0074165 A1 Mar. 10, 2022

(30) Foreign Application Priority Data

Feb. 1, 2019 (JP) ..... 2019-017390

(51) Int. Cl.
*E02F 3/43* (2006.01)
*E02F 9/12* (2006.01)
(Continued)

(52) U.S. Cl.
CPC ..... *E02F 3/435* (2013.01); *E02F 9/123* (2013.01); *E02F 9/2203* (2013.01);
(Continued)

(58) Field of Classification Search
CPC ..... E02F 3/435; E02F 9/123; E02F 9/2203; E02F 9/2271; E02F 9/262; E02F 9/265
See application file for complete search history.

(56) References Cited

U.S. PATENT DOCUMENTS 4,143,778 A * 3/1979 Ullmann ..... E02F 9/16 414/694
5,975,833 A * 11/1999 Yamada ..... E02F 9/0833 212/300
(Continued)

FOREIGN PATENT DOCUMENTS

CN 105874131 A 8/2016
CN 107268699 A 10/2017
(Continued)

*Primary Examiner* — Luis A Martinez Borrero
(74) *Attorney, Agent, or Firm* — Locke Lord LLP

(57) ABSTRACT

A control system for a construction machine includes a target value generation unit configured to generate a target value of an amount of control of working equipment, a prediction unit configured to calculate a predicted value of the amount of control of the working equipment based on the target value and a prediction model for the working equipment, and calculate an amount of drive to control the working equipment based on the predicted value, and a command unit configured to output a control command for control of the working equipment based on the amount of drive.

15 Claims, 9 Drawing Sheets

(51) Int. Cl.
*E02F 9/22* (2006.01)
*E02F 9/26* (2006.01)

(52) U.S. Cl.
CPC ..... *E02F 9/2271* (2013.01); *E02F 9/262* (2013.01); *E02F 9/265* (2013.01)

(56) References Cited

U.S. PATENT DOCUMENTS 6,140,787 A * 10/2000 Lokhorst ..... E02F 9/26 701/50
6,959,241 B2 * 10/2005 Itow ..... F02D 41/1497 123/481
9,464,406 B2 10/2016 Matsuyama et al.
9,834,908 B2 12/2017 Iwasaki et al.
10,301,794 B2 5/2019 Moriki et al.
10,704,230 B2 * 7/2020 Matsuzaki ..... F02D 31/007
10,774,502 B2 * 9/2020 Sakai ..... E02F 9/265
10,794,046 B2 10/2020 Imura et al.
10,831,213 B2 * 11/2020 Kean ..... E02F 9/24
11,085,168 B2 * 8/2021 Nakamura ..... G01G 19/18
11,149,404 B2 * 10/2021 Suzuki ..... E02F 9/2004
2004/0088103 A1 * 5/2004 Itow ..... F02D 41/1497 123/192.1
2010/0100338 A1 * 4/2010 Vik ..... G01M 5/0033 702/42
2013/0190960 A1 * 7/2013 Kawashima ..... B60W 10/06 180/65.265
2013/0325268 A1 * 12/2013 Ishihara ..... E02F 9/2246 701/50
2014/0020375 A1 * 1/2014 Fujishima ..... F02D 31/001 60/431
2014/0147238 A1 * 5/2014 Izumi ..... B66F 9/07572 701/50
2014/0200776 A1 * 7/2014 Matsuyama ..... E02F 9/264 701/50
2015/0176252 A1 * 6/2015 Kim ..... E02F 9/2066 701/50
2016/0244950 A1 * 8/2016 Kami ..... E02F 9/265
2016/0258128 A1 * 9/2016 Nakamura ..... E02F 9/265
2017/0130428 A1 * 5/2017 Matsuzaki ..... E02F 9/2246
2017/0145662 A1 5/2017 Iwasaki et al.
2017/0284057 A1 * 10/2017 Moriki ..... E02F 9/2041
2017/0342678 A1 * 11/2017 Iwamura ..... E02F 9/2033
2018/0051442 A1 * 2/2018 Igarashi ..... E02F 9/2025
2018/0355583 A1 * 12/2018 Moriki ..... E02F 3/437
2019/0017249 A1 * 1/2019 Uji ..... G07C 5/02
2019/0127946 A1 * 5/2019 Sakai ..... E02F 9/2203
2019/0218749 A1 * 7/2019 Hiromatsu ..... E02F 9/2045
2019/0226181 A1 7/2019 Imura et al.
2019/0292747 A1 * 9/2019 Takehara ..... E02F 9/262
2019/0302794 A1 * 10/2019 Kean ..... G05D 1/0214
2019/0338494 A1 * 11/2019 Moriki ..... E02F 9/2029
2020/0018037 A1 * 1/2020 Nakamura ..... E02F 3/43
2020/0141091 A1 * 5/2020 Narikawa ..... E02F 3/435
2020/0224384 A1 * 7/2020 Suzuki ..... E02F 3/435
2022/0106764 A1 * 4/2022 Iwasaki ..... E02F 3/435
2022/0106773 A1 * 4/2022 Iwasaki ..... E02F 3/435
2022/0127825 A1 * 4/2022 Iwasaki ..... E02F 9/262

FOREIGN PATENT DOCUMENTS

CN 108055855 A 5/2018
CN 109154150 A 1/2019
EP 0790355 A1 8/1997
JP 2017-179961 A 10/2017
KR 20180135939 A 12/2018
WO 2014/167718 A1 10/2014
WO 2018/30220 A1 2/2018

* cited by examiner

CONTROL SYSTEM FOR CONSTRUCTION MACHINE, CONSTRUCTION MACHINE, AND CONTROL METHOD FOR CONSTRUCTION MACHINE

FIELD

The present invention relates to a control system for a construction machine, the construction machine, and a control method for the construction machine.

BACKGROUND

In a technical field related to construction machines, there is known a control system for a construction machine that moves working equipment to follow a design surface that indicates a target shape of a construction target, as disclosed in Patent Literature 1.

CITATION LIST

Patent Literature

Patent Literature 1: WO 2014/167718 A

SUMMARY

Technical Problem

The working equipment is controlled so as not to dig below the design surface. However, depending on a condition at a construction site, the working equipment may dig below the design surface. For example, when design surfaces having various shapes are set at the construction site, it may be difficult for the working equipment to follow the design surface. In addition, when various contents of works are required at the construction site, it may be difficult for the working equipment to follow the design surface. There is a demand for a technology that can cause the working equipment to follow the design surface regardless of the condition at the construction site.

An object of the present invention according to an aspect is to cause working equipment to follow a design surface regardless of a condition at a construction site.

Solution to Problem

According to an aspect of the present invention, a control system for a construction machine including working equipment, the control system comprises: a target value generation unit configured to generate a target value of an amount of control of the working equipment; a prediction unit configured to calculate a predicted value of the amount of control of the working equipment based on the target value and a prediction model for the working equipment, and calculate an amount of drive to control the working equipment based on the predicted value; and a command unit configured to output a control command for control of the working equipment based on the amount of drive.

Advantageous Effects of Invention

According to an aspect of the present invention, the working equipment can be caused to follow the design surface regardless of the condition at the construction site.

DESCRIPTION OF EMBODIMENTS

Embodiments according to the present invention will be described below with reference to the drawings, but the present invention is not limited to this description. Component elements according to the embodiments described below can be appropriately combined with each other. Furthermore, in some cases, some of the component elements are not used.

In the following description, a three-dimensional vehicle body coordinate system (X, Y, Z) is defined, and a positional relationship between respective component elements will be described. The vehicle body coordinate system represents a coordinate system that has the origin fixed to a construction machine. The vehicle body coordinate system is defined by an X-axis that extends in a defined direction based on the origin set to the construction machine, a Y-axis that is orthogonal to the X-axis, and a Z-axis that is orthogonal to each of the X-axis and the Y-axis. A direction parallel to the X-axis is an X-axis direction. A direction parallel to the Y-axis is a Y-axis direction. A direction parallel to the Z-axis is a Z-axis direction. A rotation or tilting direction about the X-axis is a θX direction. A rotation or tilting direction about the Y-axis is a θY direction. A rotation or tilting direction about the Z-axis is a θZ direction.

[Construction Machine]

Figure 1:
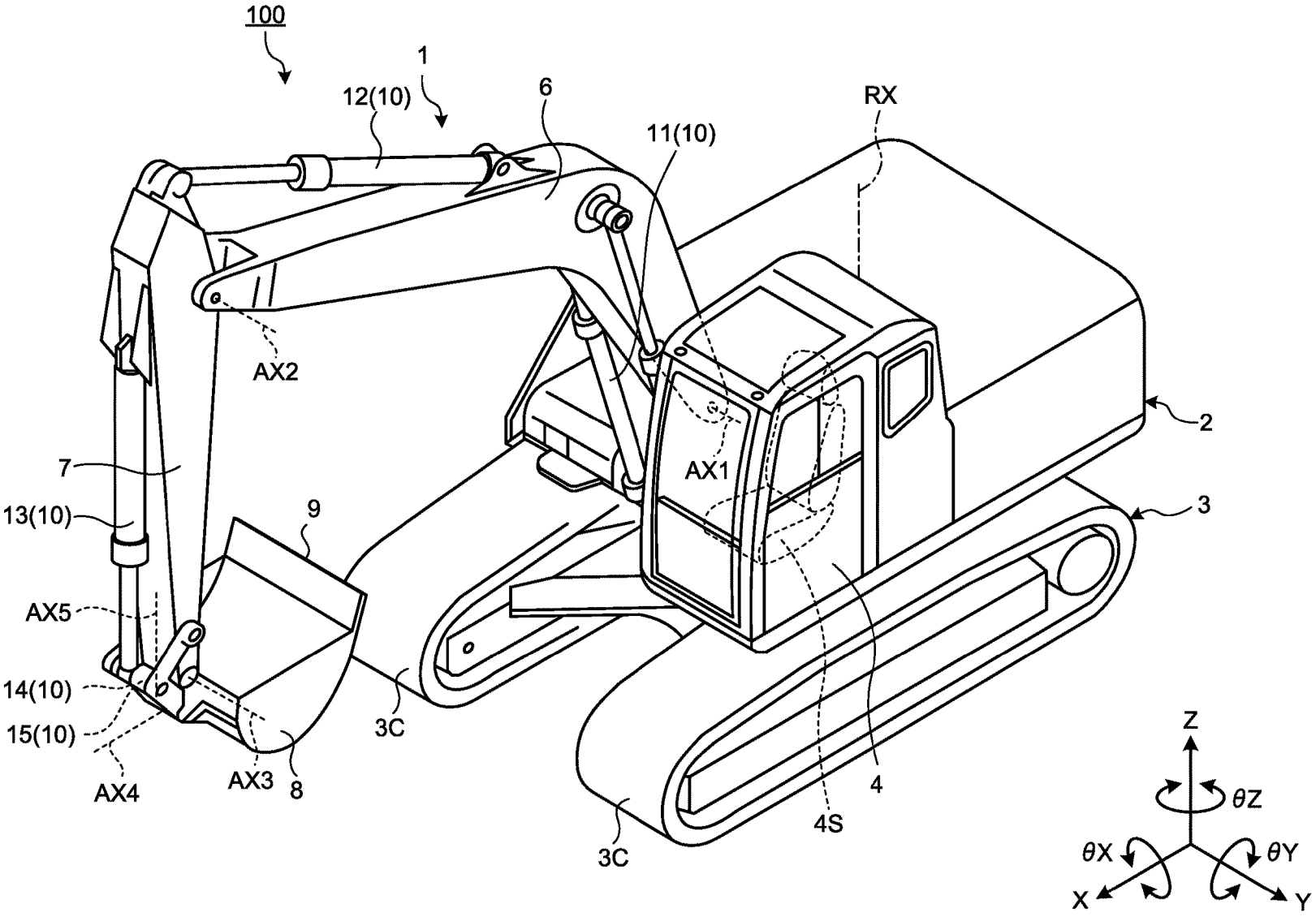
FIG. 1 is a perspective view illustrating an example of a construction machine according to the present embodiment.

FIG. 1 is a perspective view illustrating an example of a construction machine 100 according to the present embodiment. In the present embodiment, an example of the construction machine 100 as an excavator will be described. In the following description, the construction machine 100 is appropriately referred to as the excavator 100.

As illustrated in FIG. 1, the excavator 100 includes working equipment 1 that is operated by hydraulic pressure, a swing body 2 that is configured to support the working equipment 1, and a traveling body 3 that is configured to support the swing body 2. The swing body 2 has a cab 4 which a driver gets into. In the cab 4, a seat 4S on which the driver is seated is arranged. The swing body 2 is swingable about a swing axis RX with the swing body 2 supported by the traveling body 3.

The traveling body 3 has a pair of tracks 3C. The excavator 100 travels by the rotation of the tracks 3C. Note that the traveling body 3 may have tires.

The working equipment 1 is supported by the swing body 2. The working equipment 1 includes a plurality of working members movable relative to each other. The plurality of working members have the same or similar functions. In other words, each of the plurality of working members moves relative to the swing body 2 to function to perform working, such as excavation, leveling, and loading, required of the excavator 100.

The working members include a boom 6, an arm 7, and a bucket 8. The boom 6 is connected to the swing body 2. The arm 7 is connected to a distal end of the boom 6. The bucket 8 is connected to a distal end of the arm 7. The bucket 8 has a blade edge 9. In the present embodiment, the blade edge 9 of the bucket 8 is the edge of a straight blade. The blade edge 9 of the bucket 8 may be the tip of a protruded tooth provided at the bucket 8.

The boom 6 is rotatable about a boom axis AX1 relative to the swing body 2. The arm 7 is rotatable about an arm axis AX2 relative to the boom 6. The bucket 8 is rotatable relative to the arm 7 about each of a bucket axis AX3, a tilt axis AX4, and a rotating axis AX5. The boom axis AX1, arm axis AX2, and bucket axis AX3 are parallel to the Y-axis. The tilt axis AX4 is orthogonal to the bucket axis AX3. The rotating axis AX5 is orthogonal to each of the bucket axis AX3 and the tilt axis AX4. The swing axis RX is parallel to the Z-axis. The X-axis direction is a front-rear direction of the swing body 2. The Y-axis direction is a vehicle width direction of the swing body 2. The Z-axis direction is a vertical direction of the swing body 2. A direction of the working equipment 1 relative to the driver seated on the seat 4S is a front direction.

Figure 2:
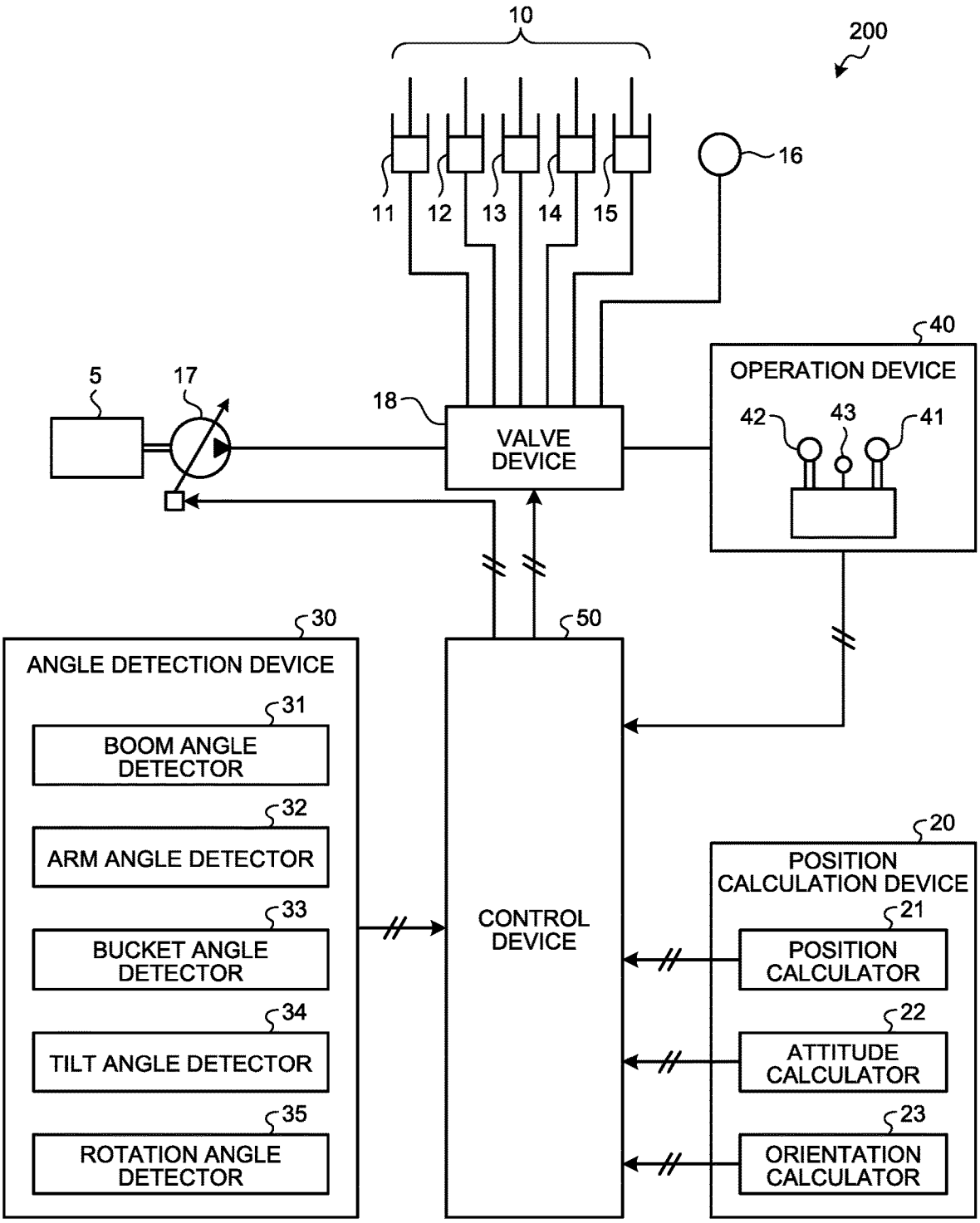
FIG. 2 is a block diagram illustrating a control system for the construction machine according to the present embodiment.
Figure 3:
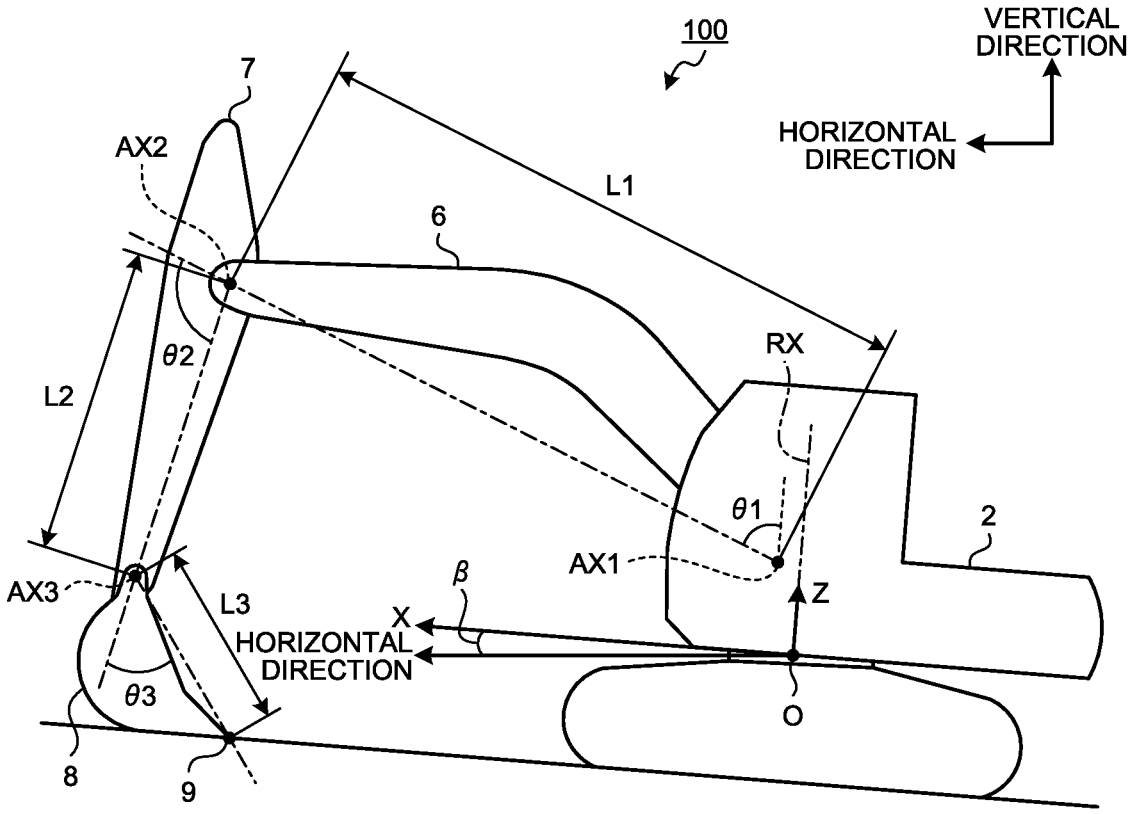
FIG. 3 is a diagram schematically illustrating the construction machine according to the present embodiment.

FIG. 2 is a block diagram illustrating a control system 200 for the excavator 100 according to the present embodiment. FIG. 3 is a diagram schematically illustrating the excavator 100 according to the present embodiment. FIG. 4(A) and FIG. 4(B) are diagrams schematically illustrating the bucket 8 according to the present embodiment.

As illustrated in FIG. 2, the control system 200 for the excavator 100 includes an engine 5, a plurality of hydraulic cylinders 10 configured to operate the working equipment 1, a swing motor 16 configured to drive the swing body 2, a hydraulic pump 17 configured to discharge hydraulic oil, a valve device 18 configured to distribute the hydraulic oil discharged from the hydraulic pump 17 to each of the plurality of hydraulic cylinders 10 and the swing motor 16, a position calculation device 20 configured to calculate positional data of the swing body 2, an angle detection device 30 configured to detect angles θ of the working equipment 1, an operation device 40 configured to operate the working equipment 1 and the swing body 2, and a control device 50.

The working equipment 1 is operated by power generated by the hydraulic cylinders 10. Each of the hydraulic cylinders 10 is driven on the basis of the hydraulic oil supplied from the hydraulic pump 17. The hydraulic cylinder 10 is a hydraulic actuator configured to operate the working members of the working equipment 1. The plurality of hydraulic cylinders 10 have the same or similar functions. In other words, the plurality of hydraulic cylinders 10 have functions for operating the plurality of working members.

The hydraulic cylinder 10 includes a boom cylinder 11 that is configured to operate the boom 6, an arm cylinder 12 that is configured to operate the arm 7, and a bucket cylinder 13, a tilt cylinder 14, and a rotating cylinder 15 that are configured to operate the bucket 8. The boom cylinder 11 generates power to rotate the boom 6 about the boom axis AX1. The arm cylinder 12 generates power to rotate the arm 7 about the arm axis AX2. The bucket cylinder 13 generates power to rotate the bucket 8 about the bucket axis AX3. The tilt cylinder 14 generates power to rotate the bucket 8 about the tilt axis AX4. The rotating cylinder 15 generates power to rotate the bucket 8 about the rotating axis AX5.

In the following description, the rotation of the bucket 8 about the bucket axis AX3 is appropriately referred to as bucket rotation, and the rotation of the bucket 8 about the tilt axis AX4 is appropriately referred to as tilt rotation, and the rotation of the bucket 8 about the rotating axis AX5 is appropriately referred to as rotation.

The swing body 2 swings by power generated by the swing motor 16. The swing motor 16 is a hydraulic motor and is driven on the basis of the hydraulic oil supplied from the hydraulic pump 17. The swing motor 16 generates power to cause the swing body 2 to swing about the swing axis RX.

The engine 5 is mounted on the swing body 2. The engine 5 generates power for driving the hydraulic pump 17.

The hydraulic pump 17 discharges the hydraulic oil for driving the hydraulic cylinder 10 and the swing motor 16.

The valve device 18 has a plurality of valves configured to distribute the hydraulic oil supplied from the hydraulic pump 17 to the plurality of hydraulic cylinders 10 and the swing motor 16. The valve device 18 adjusts the flow rate of the hydraulic oil supplied to each of the plurality of hydraulic cylinders 10. The adjustment of the flow rate of the hydraulic oil supplied to the hydraulic cylinder 10 adjusts the operating speed of the hydraulic cylinder 10. The valve device 18 regulates the flow rate of the hydraulic oil supplied to the swing motor 16. The adjustment of the flow rate of the hydraulic oil supplied to the swing motor 16 adjusts the rotation speed of the swing motor 16.

The position calculation device 20 calculates the positional data of the swing body 2. The positional data of the swing body 2 includes the position of the swing body 2, the attitude of the swing body 2, and the orientation of the swing body 2. The position calculation device 20 has a position calculator 21 configured to calculate the position of the swing body 2, an attitude calculator 22 configured to calculate the attitude of the swing body 2, and an orientation calculator 23 configured to calculate the orientation of the swing body 2.

The position calculator 21 calculates the position of the swing body 2 in a global coordinate system, as the position of the swing body 2. The position calculator 21 is arranged in the swing body 2. The global coordinate system represents a coordinate system that has the origin fixed to the earth. The global coordinate system is a coordinate system defined by a Global Navigation Satellite System (GNSS). The GNSS is a global navigation satellite system. A global positioning system (GPS) is an example of the global navigation satellite system. The GNSS has a plurality of positioning satellites. The GNSS detects a position defined by coordinate data of a latitude, a longitude, and an altitude. The swing body 2 is provided with a GPS antenna. The GPS antennas receives a radio wave from a GPS satellite and outputs a signal generated on the basis of the received radio wave to the position calculator 21. The position calculator 21 calculates the position of the swing body 2 in the global coordinate system, on the basis of the signal supplied from the GPS antenna. The position calculator 21 calculates the position of a representative point O of the swing body 2, for example, as illustrated in FIG. 3. In the example illustrated in FIG. 3, the representative point O of the swing body 2 is set on the swing axis RX. The representative point O may be set to the boom axis AX1.

The attitude calculator 22 calculates the inclination angle of the swing body 2 relative to a horizontal plane in the global coordinate system, as the attitude of the swing body 2. The attitude calculator 22 is arranged in the swing body 2. The attitude calculator 22 includes an inertial measurement unit (IMU). The inclination angle of the swing body 2 relative to the horizontal plane includes a roll angle $\alpha$ indicating an inclination angle of the swing body 2 in the vehicle width direction and a pitch angle $\beta$ indicating an inclination angle of the swing body 2 in the front-rear direction.

The orientation calculator 23 calculates the orientation of the swing body 2 relative to a reference orientation in the global coordinate system, as the orientation of the swing body 2. The reference orientation is, for example, north. The orientation calculator 23 is arranged in the swing body 2. The orientation calculator 23 includes a gyroscope sensor. The orientation calculator 23 may calculate the orientation on the basis of the signal supplied from the GPS antenna. The orientation of the swing body 2 relative to the reference orientation includes a yaw angle $\gamma$ indicating an angle formed by the reference orientation and the orientation of the swing body 2.

Figure 4:
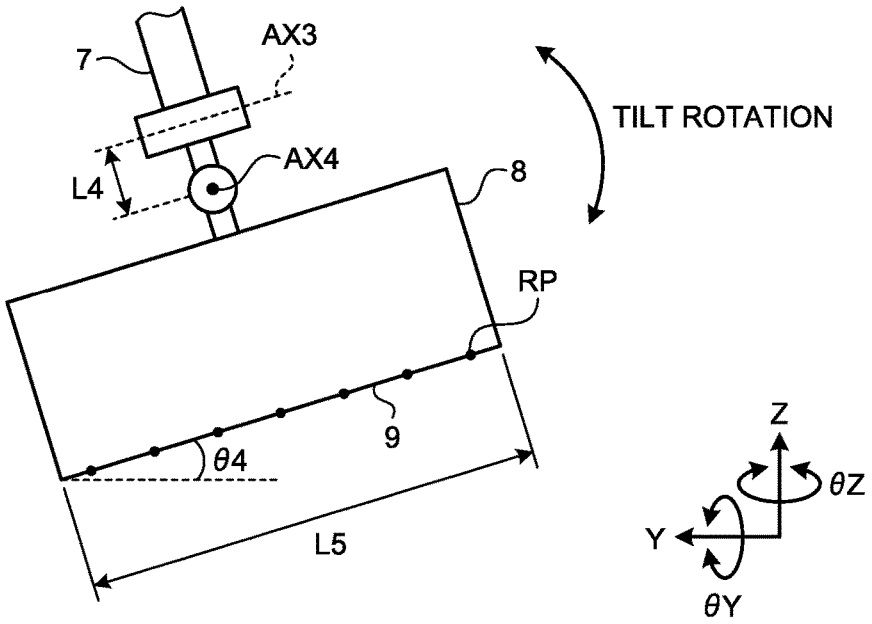
FIG. 4(A) and FIG. 4(B) are diagrams schematically illustrating a bucket according to the present embodiment.
Figure 4:
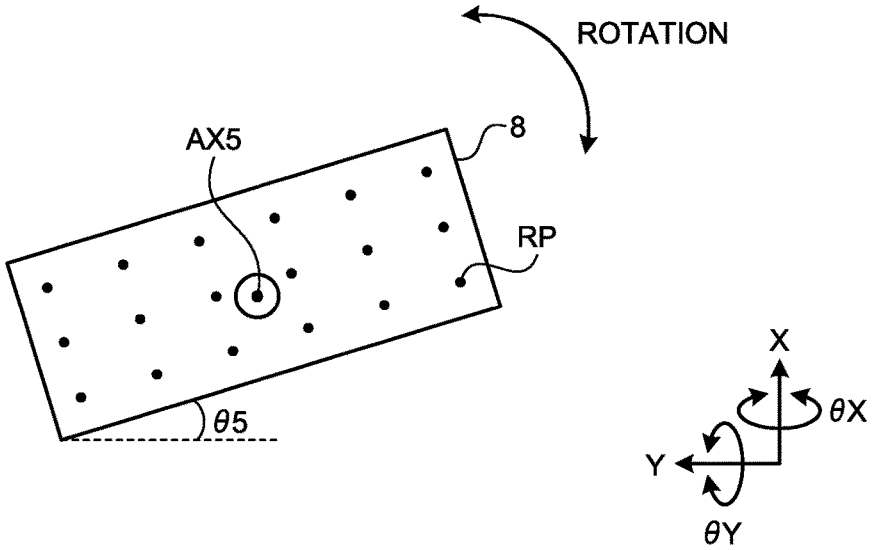

The angle detection device 30 detects the angles $\theta$ of the working equipment 1. The angle detection device is arranged in the working equipment 1. As illustrated in FIGS. 3 and 4, the angles $\theta$ of the working equipment 1 include a boom angle $\theta 1$ that indicates the angle of the boom 6 relative to the Z-axis, an arm angle $\theta 2$ that indicates the angle of the arm 7 relative to the boom 6, a bucket angle $\theta 3$ that indicates the angle of the bucket 8 in a bucket rotation direction relative to the arm 7, a tilt angle $\theta 4$ that indicates the angle of the bucket 8 in a tilt rotation direction relative to an XY plane, and a rotation angle $\theta 5$ that indicates the angle of the bucket 8 in a rotation direction relative to a YZ plane.

The angle detection device 30 has a boom angle detector 31 that detects the boom angle $\theta 1$, an arm angle detector 32 that detects the arm angle $\theta 2$, a bucket angle detector 33 that detects the bucket angle $\theta 3$, a tilt angle detector 34 that detects the tilt angle $\theta 4$, and a rotation angle detector 35 that detects the rotation angle $\theta 5$. The angle detection device 30 may include a stroke sensor configured to detect a stroke of the hydraulic cylinder 10, or may include an angle sensor, such as a rotary encoder, configured to detect the angles $\theta$ of the working equipment 1. When the angle detection device 30 includes the stroke sensor, the angle detection device 30 calculates the angles $\theta$ of the working equipment 1 on the basis of detection data of the stroke sensor.

The operation device 40 is operated by the driver to drive the hydraulic cylinder 10 and the swing motor 16. The operation device 40 is arranged in the cab 4. Operation of the operation device 40 by the driver operates the working equipment 1. The operation device 40 includes a lever that is operated by the driver of the excavator 100. The lever of the operation device 40 includes a right operating lever 41, a left operating lever 42, and a tilt operating lever 43.

When the right operating lever 41 in a neutral position is operated forward, the boom 6 is operated to lower, and when the right operating lever 41 is operated backward, the boom 6 is operated to rise. When the right operating lever 41 in the neutral position is operated rightward, the bucket 8 dumps, and when the right operating lever 41 is operated leftward, the bucket 8 digs.

When the left operating lever 42 in a neutral position is operated forward, the arm 7 dumps, and when the left operating lever 42 is operated backward, the arm 7 digs. When the left operating lever 42 in the neutral position is operated rightward, the swing body 2 swings rightward, and when the left operating lever 42 is operated to leftward, the swing body 2 swings leftward.

Operation of the tilt operating lever 43 causes a tilt rotation or rotation of the bucket 8.

[Control Device]

Figure 5:
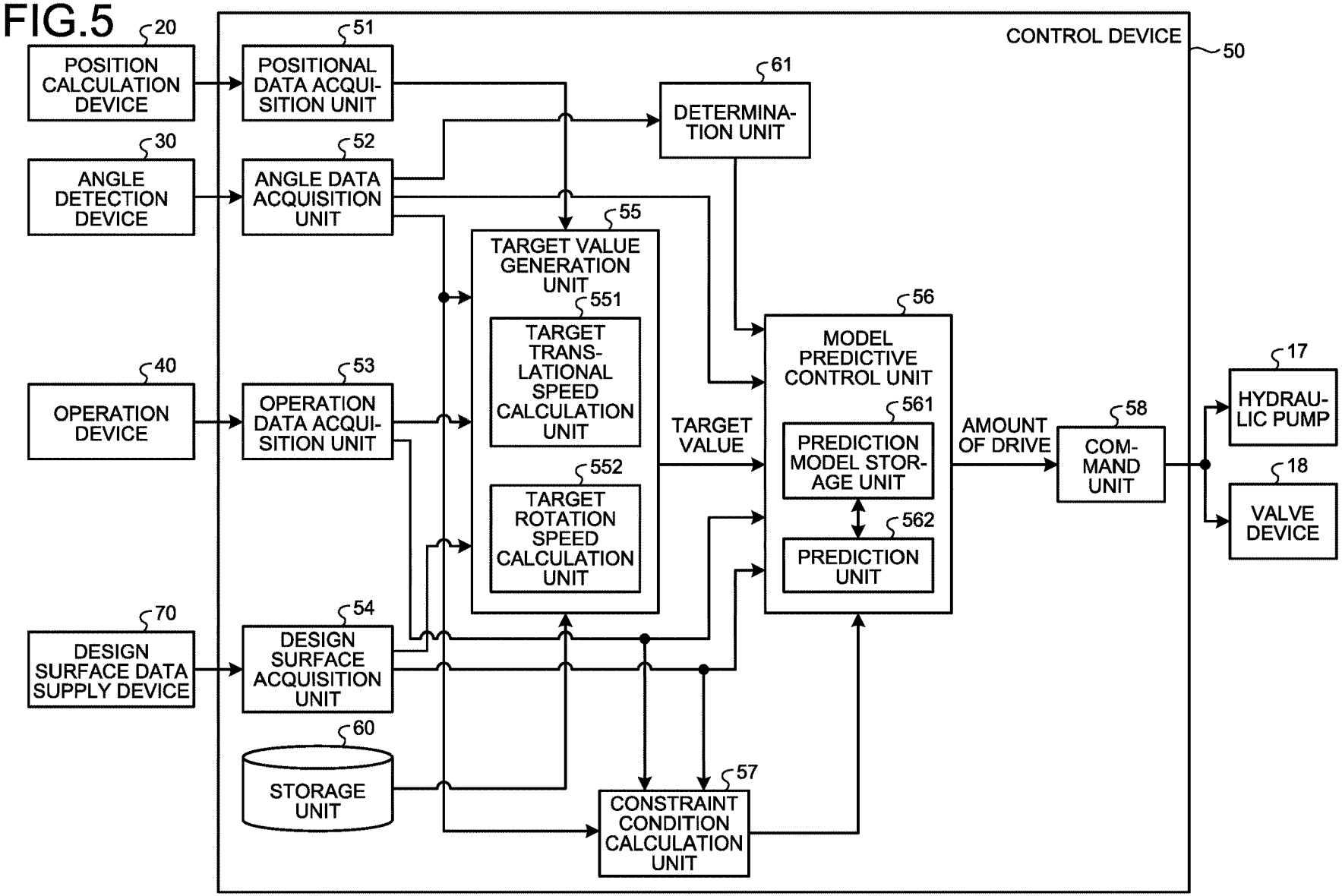
FIG. 5 is a functional block diagram illustrating a control device according to the present embodiment.

FIG. 5 is a functional block diagram illustrating the control device 50 according to the present embodiment. The control device 50 includes a positional data acquisition unit 51, an angle data acquisition unit 52, an operation data acquisition unit 53, a design surface acquisition unit 54, a target value generation unit 55, a model predictive control unit 56, a constraint condition calculation unit 57, a command unit 58, a determination unit 61, and a storage unit 60.

The positional data acquisition unit 51 acquires the positional data of the swing body 2 from the position calculation device 20. The positional data of the swing body 2 includes the position of the swing body 2, the attitude of the swing body 2, and the orientation of the swing body 2.

The angle data acquisition unit 52 acquires angle data indicating the angles $\theta$ of the working equipment 1 from the angle detection device 30. The angle data of the working equipment 1 includes the boom angle $\theta 1$, the arm angle $\theta 2$, the bucket angle $\theta 3$, the tilt angle $\theta 4$, and the rotation angle $\theta 5$.

The operation data acquisition unit 53 acquires operation data of the operation device 40 operating the working equipment 1. The operation data of the operation device 40 includes an amount of operation of the operation device 40. The operation device 40 is provided with an operation amount sensor that detects an amount of operation of each lever. The operation data acquisition unit 53 acquires the operation data of the operation device 40 from the operation amount sensor of the operation device 40.

The design surface acquisition unit 54 acquires a design surface that indicates a target shape of a construction target. The design surface indicates a three-dimensional target shape after construction by the excavator 100. In the present embodiment, a design surface data supply device 70 generates design surface data that indicates the design surface. The design surface acquisition unit 54 acquires the design surface data from the design surface data supply device 70. The design surface data supply device 70 may be provided at a distant place from the excavator 100. The design surface data generated by the design surface data supply device 70 may be transmitted to the control device 50 via a communication system. Note that the design surface data generated by the design surface data supply device 70 may be stored in the storage unit 60. The design surface acquisition unit 54 may acquire the design surface data from the storage unit 60.

The target value generation unit 55 generates a target value of an amount of control of the working equipment 1. In the present embodiment, the amount of control of the working equipment 1 includes one or both of a moving speed of the bucket 8 and the position of a predetermined portion of the bucket 8. The predetermined portion of the bucket 8 includes the blade edge 9 of the bucket 8. The moving speed of the bucket 8 includes a moving speed of the blade edge 9. The position of the predetermined portion of the bucket 8 includes the position of the blade edge 9. The target value generation unit 55 generates the target value of the amount of control of the working equipment 1, on the basis of the operation data acquired by the operation data acquisition unit 53.

In the following description, it is assumed that the predetermined portion of the bucket 8 is the blade edge 9. Note that the predetermined portion of the bucket 8 may not necessarily be the blade edge 9. The predetermined portion of the bucket 8 may be a floor surface (bottom surface) of the bucket 8.

The moving speed of the bucket 8 includes a translational speed and a rotation speed of the bucket 8. The translational speed of the bucket 8 represents a moving speed in each of the X-axis direction, the Y-axis direction, and the Z-axis direction. The rotation speed of the bucket 8 represents a rotational angular speed in each of the θX direction, the θY direction, and the θZ direction. In the present embodiment, the target value generation unit 55 includes a target translational speed calculation unit 551 configured to calculate a target translational speed $v_{target}$ that is a target value of the translational speed, and a target rotation speed calculation unit 552 configured to calculate a target rotation speed $\omega_{target}$ that is a target value of the rotation speed. The target value generation unit 55 calculates each of the target translational speed $v_{target}$ and the target rotation speed $\omega_{target}$, on the basis of the angle data acquired by the angle data acquisition unit 52, the operation data acquired by the operation data acquisition unit 53, and the design surface acquired by the design surface acquisition unit 54.

Figure 6:
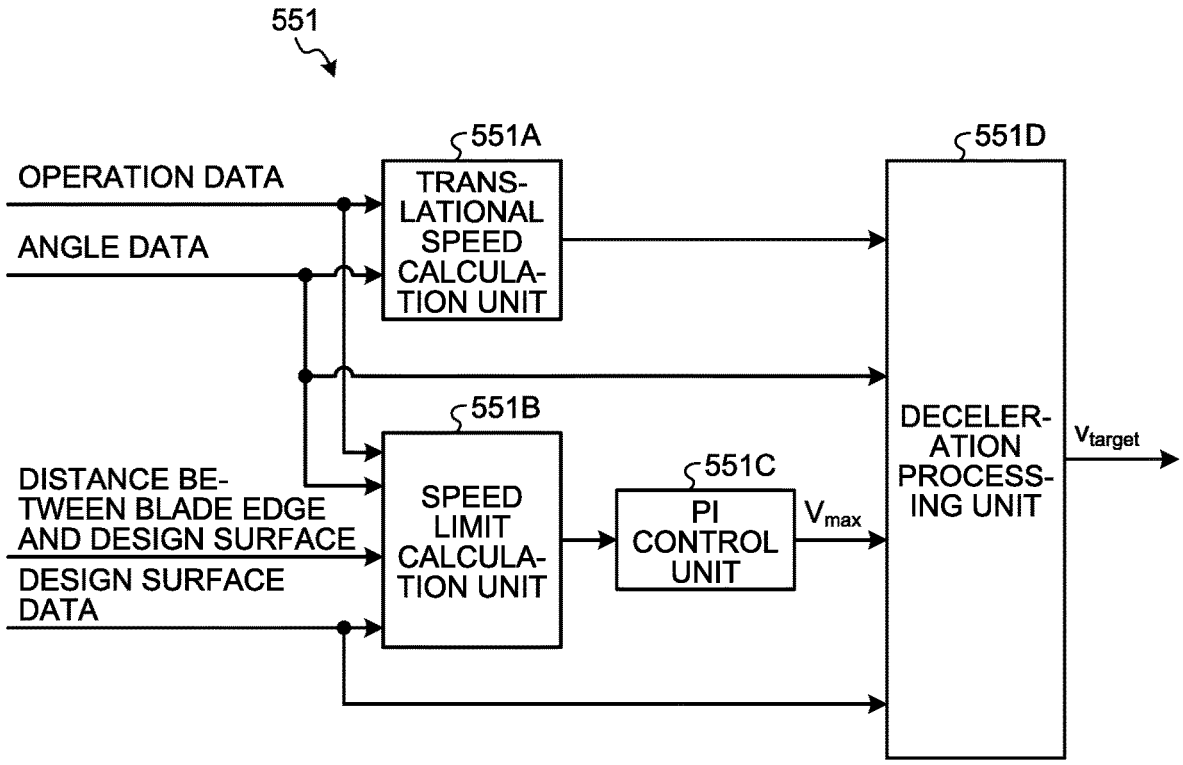
FIG. 6 is a diagram illustrating a method of calculating a target translational speed of the bucket by a target translational speed calculation unit according to the present embodiment.

FIG. 6 is a diagram illustrating a method of calculating the target translational speed $v_{target}$ of the bucket 8 by the target translational speed calculation unit 551 according to the present embodiment. The target translational speed calculation unit 551 includes a translational speed calculation unit 551A configured to calculate the translational speed of the bucket 8 on the basis of the operation data of the operation device 40 and the angle data of the working equipment 1, a speed limit calculation unit 551B configured to calculate a speed limit of the bucket 8 on the basis of a distance between the blade edge 9 and the design surface and the design surface data, a PI control unit 551C, and a deceleration processing unit 551D.

The target translational speed calculation unit 551 calculates the target translational speed $v_{target}$ of the bucket 8 so as not to dig below the design surface. The target translational speed $v_{target}$ of the bucket 8 is calculated on the basis of formulas (1) to (6).

$$v_{targent} = {}^{w}R_1 \begin{bmatrix} 1 & 0 & 0 \\ 0 & 0 & 0 \\ 0 & 0 & 1 \end{bmatrix} (a+b) + j_v \begin{bmatrix} \dot{\theta}_{ope_1} & 0 & 0 & 0 & 0 \end{bmatrix}^T \tag{1}$$

$$a = \begin{cases} ({}^1v_{sagyo} \cdot {}^1e_{XZ}){}^1e_{XZ} & (({}^1v_{sagyo} \cdot {}^1e_{XZ}) > V_{MAX}) \\ V_{MAX}{}^1e_{XZ} & (({}^1v_{sagyo} \cdot {}^1e_{XZ}) \le V_{MAX}) \end{cases} \tag{2}$$

$$b = {}^1v_{sagyo} - ({}^1v_{sagyo} \cdot {}^1e_{XZ}){}^1e_{XZ} \tag{3}$$

$${}^1e_{XZ} = -\begin{bmatrix} 1 & 0 & 0 \\ 0 & 0 & 0 \\ 0 & 0 & 1 \end{bmatrix} {}^1R_w n \tag{4}$$

$$v_{sagyo} = J_v \begin{bmatrix} 0 & 0 & 0 & 0 & 0 \\ 0 & 1 & 0 & 0 & 0 \\ 0 & 0 & 1 & 0 & 0 \\ 0 & 0 & 0 & 0 & 0 \\ 0 & 0 & 0 & 0 & 0 \end{bmatrix} \dot{\theta}_{ope} \tag{5}$$

-continued $$J = \begin{bmatrix} J_v \\ J_\omega \end{bmatrix} \tag{6}$$

$n \in R^3$ is a unit normal vector of the design surface closest to the blade edge 9, ${}^{w}R1 \in R^{3\times3}$ is a rotation matrix for transformation from the vehicle body coordinate system to the global coordinate system, $v_{sagyo} \in R^3$ is a translational speed component of the bucket operated by the boom 6 and the arm 7 on a working equipment plane (XZ plane in the vehicle body coordinate system) of the translational speed upon operation of the working equipment 1 based on the operation of the operation device 40, and $V_{MAX}$ is a maximum speed of the bucket 8 in a direction normal to the design surface, for prevention of digging below the design surface. $J_v \in R^{3\times5}$ and $J_\omega \in R^{3\times5}$ represent a translational speed component and a rotation speed component of the Jacobian matrix, respectively.

The target translational speed calculation unit 551 is configured to calculate the distance between the blade edge 9 and the design surface, on the basis of the positional data of the swing body 2 acquired by the positional data acquisition unit 51, the angle data of the working equipment 1 acquired by the angle data acquisition unit 52, and working equipment data stored in the storage unit 60. As illustrated in FIGS. 3 and 4, the working equipment data includes a boom length L1, an arm length L2, a bucket length L3, a tilt length L4, and a bucket width L5. The boom length L1 is a distance between the boom axis AX1 and the arm axis AX2. The arm length L2 is a distance between the arm axis AX2 and the bucket axis AX3. The bucket length L3 is a distance between the bucket axis AX3 and the blade edge 9 of the bucket 8. The tilt length L4 is a distance between the bucket axis AX3 and the tilt axis AX4. The bucket width L5 is a dimension in a width direction of the bucket 8. The working equipment data includes bucket profile data that indicates the shape and dimensions of the bucket 8. The bucket profile data includes external surface data of the bucket 8 including the profile of an external surface of the bucket 8. The bucket profile data includes coordinate data of a plurality of outline points RP of the bucket 8 on the basis of the predetermined portion of the bucket 8.

The target translational speed calculation unit 551 calculates positional data of each of the outline points RP. The target translational speed calculation unit 551 calculates a relative position between the representative point O of the swing body 2 and each of the plurality of outline points RP, in the vehicle body coordinate system. The target translational speed calculation unit 551 is configured to calculate the relative position between the representative point O of the swing body 2 and each of the plurality of outline points RP of the bucket 8, in the vehicle body coordinate system, on the basis of the working equipment data including the boom length L1, the arm length L2, the bucket length L3, the tilt length L4, the bucket width L5, and the bucket profile data, and the angle data of the working equipment 1 including the boom angle θ1, the arm angle θ2, the bucket angle θ3, the tilt angle θ4, and the rotation angle θ5. Setting of the outline points RP to the blade edge 9 makes it possible for the target translational speed calculation unit 551 to calculate a relative position between the representative point O and the blade edge 9. The design surface is defined in the vehicle body coordinate system. Therefore, the target translational speed calculation unit 551 is allowed to calculate the distance between the blade edge 9 and the design surface in the vehicle body coordinate system. In addition, the target translational speed calculation unit 551 calculates a position of each of the plurality of outline points RP in the global coordinate system. The target translational speed calculation unit 551 is allowed to calculate the position of each outline point RP of the bucket 8 in the global coordinate system, on the basis of an absolute position of the representative point O of the swing body 2 and the relative position between the representative point O of the swing body 2 and the position of the outline point RP of the bucket 8.

The speed limit calculation unit 551B determines a speed limit of the boom 6 in the direction normal to the design surface by using a speed limit table indicating a relationship of the distance between the bucket 8 and the design surface to a speed limit of the working equipment 1.

Figure 7:
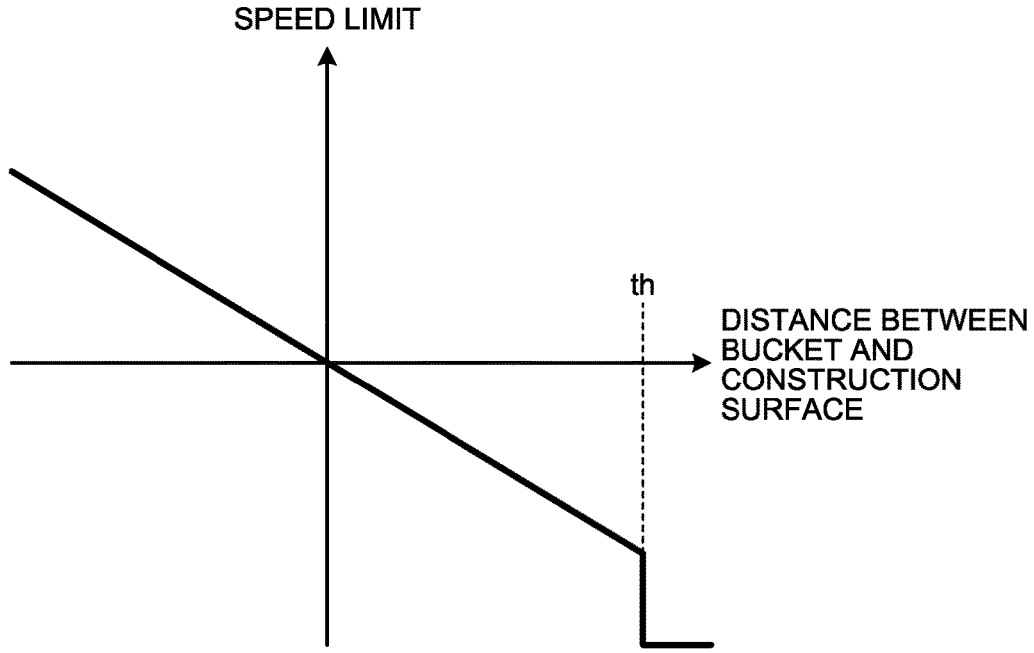
FIG. 7 is a graph illustrating an example of a speed limit table according to the present embodiment.

FIG. 7 is a graph illustrating an example of the speed limit table according to the present embodiment. As illustrated in FIG. 7, the speed limit table indicates the relationship of the distance between the blade edge 9 and the design surface to the speed limit of the working equipment 1. In the speed limit table, when the distance between the blade edge 9 and the design surface is 0, the speed of the working equipment 1 in the direction normal to the design surface becomes 0. In the speed limit table, when the blade edge 9 is placed above a construction surface, the distance between the blade edge 9 and the design surface has a positive value. When the blade edge 9 is placed below the construction surface, the distance between the blade edge 9 and the construction surface has a negative value. In the speed limit table, a speed for moving the blade edge 9 upward has a positive value. When the distance between the blade edge 9 and the construction surface is equal to or less than a working equipment control threshold th that has a positive value, the speed limit of the working equipment 1 is defined on the basis of the distance between the blade edge 9 and the construction surface. When the distance between the blade edge 9 and the construction surface is equal to or larger than the working equipment control threshold th, an absolute value of the speed limit of the working equipment 1 has a value that is larger than a maximum value of a target speed of the working equipment 1. In other words, when the distance between the blade edge 9 and the construction surface is equal to or larger than the working equipment control threshold th, an absolute value of the target speed of the working equipment 1 is always smaller than the absolute value of the speed limit, and thus, the boom 6 is always driven at the target speed.

Figure 8:
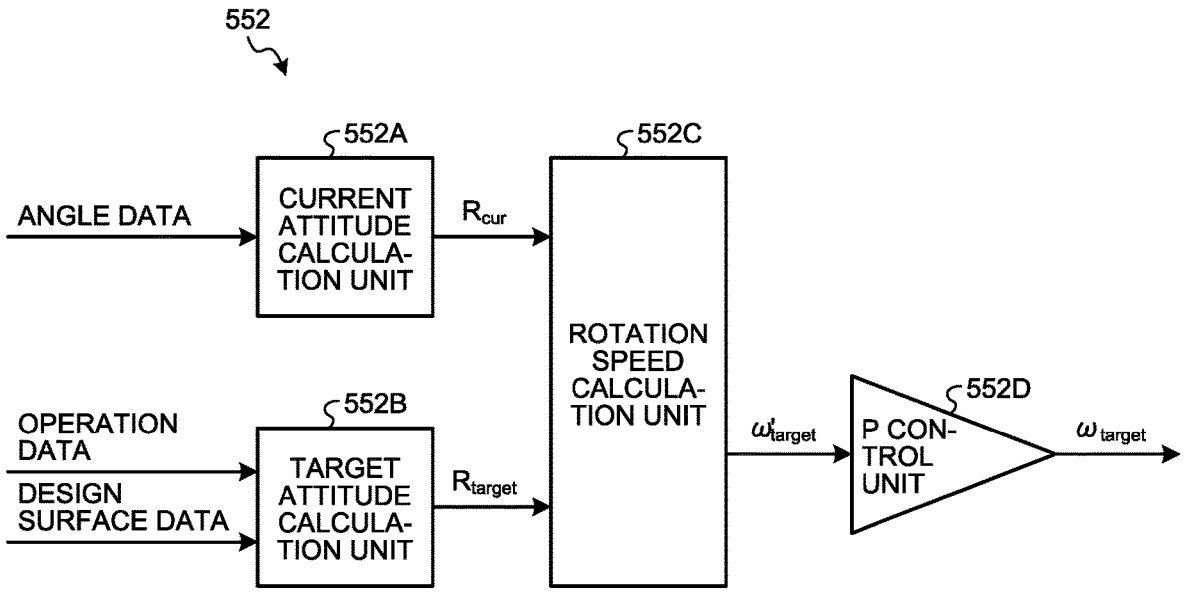
FIG. 8 is a diagram illustrating a method of calculating a target rotation speed of the bucket by a target rotation speed calculation unit according to the present embodiment.

FIG. 8 is a diagram illustrating a method of calculating the target rotation speed ($R_{target}$ of the bucket 8 by the target rotation speed calculation unit 552 according to the present embodiment. The target rotation speed calculation unit 552 includes a current attitude calculation unit 552A configured to calculate a current attitude $R_{cur}$ of the bucket 8 on the basis of the angle data of the working equipment 1, a target attitude calculation unit 552B configured to calculate a target attitude $R_{target}$ of the bucket 8 on the basis of the operation data of the operation device 40 and the design surface data, a rotation speed calculation unit 552C configured to calculate a rotation speed $\omega'_{target}$ on the basis of the current attitude $R_{cur}$ and the target attitude $R_{target}$ of the bucket 8, and a P control unit 552D configured to perform P control on the rotation speed $\omega'_{target}$ to calculate the target rotation speed $\omega_{target}$.

The rotation speed $\omega'_{target}$ is calculated on the basis of formulas (7) to (10).

$$\omega'_{target} = R_{cur}\omega \tag{7}$$

$$\theta = \cos^{-1}\left(\frac{r_{11} + r_{22} + r_{33} - 1}{2}\right) \tag{8}$$

$$\omega = \begin{cases} [0 \quad 0 \quad 0]^T & (\theta = 0) \\ \dfrac{\theta}{2\Delta T_{target}\sin\theta}\begin{bmatrix} r_{32} - r_{23} \\ r_{13} - r_{31} \\ r_{21} - r_{12} \end{bmatrix} & (\theta \neq 0) \end{cases} \tag{9}$$

$$R = \begin{bmatrix} r_{11} & r_{12} & r_{13} \\ r_{21} & r_{22} & r_{23} \\ r_{31} & r_{32} & r_{33} \end{bmatrix} = R_{cur}^T R_{target} \tag{10}$$

$\Delta T_{target}$ is a parameter corresponding to a time required to correct the attitude of the bucket 8. The P control unit 552D calculates the target rotation speed $\omega_{target}$ by performing P control on the basis of the rotation speed $\omega'_{target}$ calculated by the rotation speed calculation unit 552C.

The model predictive control unit 56 calculates a predicted value of the amount of control of the working equipment 1 on the basis of the target value of the amount of control of the working equipment 1 generated by the target value generation unit 55 and a prediction model for the working equipment 1. The model predictive control unit 56 calculates an amount of drive to control the working equipment 1 on the basis of the predicted value. The model predictive control unit 56 has a prediction model storage unit 561 configured to store the prediction model for the working equipment 1, and a prediction unit 562 configured to calculate the predicted value of the amount of control of the working equipment 1 on the basis of the target value of the amount of control of the working equipment 1 and the prediction model for the working equipment 1, and calculate the amount of drive to control the working equipment 1 on the basis of the predicted value of the amount of control of the working equipment 1.

The prediction model storage unit 561 stores a prediction model for the excavator 100 including the working equipment 1. The prediction model includes a dynamic model for the excavator 100. The prediction model includes a model for the swing body 2 that swings about the swing axis RX, a model for the boom 6 that rotates about the boom axis AX1, a model for the arm 7 that rotates about the arm axis AX2, and a model for the bucket 8 that rotates about the bucket axis AX3, tilt axis AX4, and rotating axis AX5.

The prediction model is represented by a discrete state equation and an output equation. The state equation of the prediction model for control of the excavator 100, discretized with a sampling time ΔT is shown in formula (11). Matrices of the state equation is shown in formulas (12) and (13). The output equation of the prediction model is shown in formula (14).

$$\begin{bmatrix} \theta(t+1) \\ \dot{\theta}(t+1) \end{bmatrix} = A\begin{bmatrix} \theta(t) \\ \dot{\theta}(t) \end{bmatrix} + B\begin{bmatrix} \tau(t) \\ -C_o(t) \\ C_{tay}(t) \end{bmatrix} \tag{11}$$

$$A = \begin{bmatrix} I_{5\times5} & I_{5\times5}\Delta T \\ O_{5\times5} & I_{5\times5} \end{bmatrix} \in R^{10\times10} \tag{12}$$

$$B = \begin{bmatrix} \frac{1}{2}\Delta T^2 M^{-1} & \frac{1}{2}\Delta T^2 M^{-1} & O_{5\times4} \\ \Delta T M^{-1} & \Delta T M^{-1} & O_{5\times4} \end{bmatrix} \in R^{10\times14} \tag{13}$$

-continued $$\begin{bmatrix} v(t) \\ \omega(t) \\ \theta(t)^T \\ \dot{\theta}(t)^T \\ d(t) \\ Q_A(t) \end{bmatrix} = C\begin{bmatrix} \theta(t) \\ \dot{\theta}(t) \end{bmatrix} + D\begin{bmatrix} \tau(t) \\ -C_o(t) \\ C_{tay}(t) \end{bmatrix} \tag{14}$$

Each of $M \in R^{5\times5}$ and $Co \in R^5$ is an inertial matrix of an equation of motion and a Coriolis force/gravity vector. $C_{tay} \in R^{2np}$ is a constant term when a tailor expansion of n·p around an angle θ is performed at the predetermined time t. $n_p$ is the number of design surfaces to be considered. Outputs from the output equation of the prediction model are an angle θ, an angular speed, the target translational speed $v_{target}$, the target rotation speed $\omega_{target}$, the distance d between the blade edge 9 and the design surface, and the flow rate Q of the hydraulic oil.

The prediction unit 562 performs an optimization operation on the basis of the prediction model and calculates the predicted value of the amount of control of the working equipment 1. As described above, in the present embodiment, the amount of control of the working equipment 1 includes one or both of the moving speed of the bucket 8 and the position of the predetermined portion of the bucket 8. The predetermined portion of the bucket 8 includes the blade edge 9. Furthermore, the amount of control of the working equipment 1 includes an angular speed of the boom 6, an angular speed of the arm 7, and an angular speed of the bucket 8. The angular speed of the bucket 8 includes an angular speed about the bucket axis AX3, an angular speed about the tilt axis AX4, and an angular speed about the rotating axis AX5.

The prediction unit 562 predicts a value on the left side of formula (14) several steps ahead from the present time.

The prediction unit 562 calculates the amount of drive to control the working equipment 1, on the basis of at least one of a predicted value of the moving speed of the bucket 8, a predicted value of the angular speed of each axis, a predicted value of the position of the blade edge 9 of the bucket 8, and a predicted value of the flow rate of the hydraulic oil. The prediction unit 562 calculates the amount of drive so that the predicted value of the amount of control follows the target value thereof.

In the present embodiment, the prediction unit 562 calculates the amount of drive so that the bucket 8 in a predetermined attitude follows a target design surface, on the basis of the predicted value of the moving speed of the bucket 8, the predicted value of the angular speed of each axis, the predicted value of the position of the blade edge 9 of the bucket 8, the predicted value of the flow rate of the hydraulic oil, a predicted value of a swing speed of the swing body 2 and the design surface. In other words, the prediction unit 562 calculates the amount of drive so that the bucket 8 does not dig below the design surface and the position of the blade edge 9 and the position of the design surface coincide with each other.

The prediction unit 562 calculates the amount of drive to control the working equipment 1 and the swing body 2 so that an evaluation function has a minimum value and each constraint condition is satisfied.

In model predictive control, the evaluation function as shown in formula (15) is generally used.

$$E(t)=E_y(t)+E_u(t)+E_{\Delta u}(t)+E_c(t) \tag{15}$$

$E_y(t)$ is a difference between a target value and a predicted value in output, $E_u(t)$ is a difference between a target value and a predicted value in input, $E\Delta_u(t)$ is a magnitude of the change in input, and $E_c(t)$ is a penalty function that is imposed when the constraint conditions which are described later are not satisfied. In the present embodiment, $E_u(t)=0$ and $E\Delta_u(t)=0$, and a tracking error in output with respect to the target value in output is used as the evaluation function. The evaluation function is shown in formulas (16) and (17).

$$E(t) = \sum_{i=1}^{H_p} \Delta r_i(t+i|t)^T W \Delta r_i(t+i|t) + E_c(t) \tag{16}$$

$$\Delta r_i(t+i|t) = r_i(t+i|t) - y(t+i|t) \tag{17}$$

r(t+i|t) is a target value of time t+i at the time t, y(t+i|t) is a plant output at the time t+i predicted at the time t, H, is a prediction horizon that determines how many steps ahead a prediction is made, and W is a diagonal matrix that weights to make a prediction variables.

The constraint condition calculation unit 57 calculates the constraint conditions. The constraints include a first constraint condition relating to the performance of the excavator 100 and a second constraint condition relating to the position of the bucket 8. The prediction unit 562 calculates the amount of drive so as to satisfy the constraint conditions calculated by the constraint condition calculation unit 57.

The excavator 100 as a control target has a limit on the angles θ, angular speed, angular acceleration, and the flow rate of the hydraulic oil, of the working equipment 1. In other words, the working members of the working equipment 1 each have a functional range indicating a range in which the working member functions. The functional range of the working members each include a range of movement of each working member. For example, each angle θ through which the working equipment 1 is movable has a limit value. Likewise, each of the angular speed and angular acceleration of the working equipment 1 has a limit value.

Furthermore, the flow rate of the hydraulic oil discharged from the hydraulic pump 17 has a limit. In other words, the flow rate of the hydraulic oil supplied from the hydraulic pump 17 to the hydraulic cylinder 10 has a limit value, depending on the performance or the like of the hydraulic pump 17. Furthermore, each hydraulic cylinder 10 has a functional range indicating a range in which the hydraulic cylinder 10 functions. The functional range of the hydraulic cylinder 10 includes a hydraulic oil supply range defined for the hydraulic cylinder 10. For the hydraulic cylinder 10, a minimum value $Q_{wm_min}$ and a maximum value $Q_{wm_max}$ that are limit values of a hydraulic oil supply flow rate $Q_{wm}$ indicating the flow rate of the hydraulic oil supplied from the hydraulic pump 17 to the hydraulic cylinder 10 via the valve device 18. The hydraulic oil supply flow rate $Q_{wm}$ for the hydraulic cylinder 10 includes a hydraulic oil supply flow rate $Q_{bm}$ for the boom cylinder 11, a hydraulic oil supply flow rate $Q_{ar}$ for the arm cylinder 12, and a hydraulic oil supply flow rate $Q_{bk}$ for the bucket cylinder 13. The same applies to the tilt cylinder and the rotating cylinder. For the boom cylinder 11, a minimum value $Q_{bm_min}$ and a maximum value $Q_{bm_max}$ that are limit values of the hydraulic oil supply flow rate $Q_{bm}$ are defined. For the arm cylinder 12, a minimum value $Q_{ar_min}$ and a maximum value $Q_{ar_max}$ that are limit values of the hydraulic oil supply flow rate $Q_{ar}$ are defined. For the bucket cylinder 13, a minimum value $Q_{bk_min}$ and a maximum value $Q_{bk_max}$ that are limit values of the hydraulic oil supply flow rate $Q_{bk}$ are defined. The same applies to the tilt cylinder 14 and the rotating cylinder 15. The hydraulic oil supply range defined for the hydraulic cylinder 10 is in the range between the minimum value $Q_{wm_min}$ and the maximum value $Q_{wm_max}$.

As described above, the excavator 100 has a limit on hardware. Therefore, it is necessary to consider the first constraint condition indicating limitation on the hardware of the excavator 100, also in the model predictive control. The constraint condition calculation unit 57 calculates the first constraint condition including the angles θ, angular speed, angular acceleration, and flow rate of the hydraulic oil, of the working equipment 1. The prediction unit 562 calculates the amount of drive so as to satisfy the first constraint condition.

The constraint conditions of the angles θ, the angular speed, and the flow rate of the hydraulic oil are shown in formulas (18) to (21).

$$\theta_{min} \le \theta(t) \le \theta_{max} \tag{18}$$

$$\dot{\theta}_{min} \le \dot{\theta}(t) \le \dot{\theta}_{max} \tag{19}$$

$$Q_A(t) = \sum_{i=1}^{5} Q_i \le Q_{A_{max}} \tag{20}$$

$$Q_A = G\dot{\theta} \le Q_{A_{max}} 1_{32\times 1} \tag{21}$$

The constraint condition of the angular acceleration are shown in formula (22).

$$\ddot{\theta}_{min} \le \ddot{\theta}(t) \le \ddot{\theta}_{max} \tag{22}$$

In the present embodiment, the constraint condition calculation unit 57 converts the constraint condition of the angular acceleration into the constraint condition of torque. The constraint condition of the angular acceleration after conversion is shown in formula (23).

$$\ddot{\theta}_{min} \le M^{-1}(t)\tau(t) - M^{-1}(t)C_o(t) \le \ddot{\theta}_{max} \tag{23}$$

In control of the working equipment 1, it is necessary to prevent the bucket 8 from digging below the design surface. In other words, the bucket 8 has a limit on position so as not to dig below the design surface. Therefore, it is necessary to consider the second constraint condition indicating limitation on the position of the bucket 8, also in the model predictive control. The constraint condition calculation unit 57 calculates the second constraint condition including the position of the bucket 8 relative to the design surface. The prediction unit 562 calculates the amount of drive so as to satisfy the second constraint condition.

An output d(t) indicates the distance between the blade edge 9 and the design surface. An equation of the i-th design surface is represented by a unit normal vector $n_i$ as $n \cdot p + d_i = 0$. Formulas (24) and (25) show the constraint conditions for preventing the right and left ends of the blade edge 9 from digging below the design surface.

$$n_i \cdot p_L(t) \ge -d_i \tag{24}$$

$$n_i \cdot p_R(t) \ge -d_i \tag{25}$$

The coordinates of the blade edge 9 are non-linear with respect to an angle θ in a state variable. Therefore, a linear approximation is applied as shown in formulas (26) and (27).

$$n_i \cdot p_L(t) = C_{i_L}\theta(t) + C_{tay_{i_L}} \tag{26}$$

$$n_i \cdot p_R(t) = C_{i_R}\theta(t) + C_{tay_{i_R}} \tag{27}$$

The prediction unit 562 uses the evaluation functions shown in formulas (16) and (17) to perform the optimization operation in the model predictive control so as to satisfy the constraint conditions shown in formulas (18) to (27). An optimization problem in the present embodiment is shown in formula (28). For example, quadratic programming (QP) is used for the optimization operation, but another calculation method may be used.

$$\begin{aligned} &\underset{\tau(1),\ldots,\tau(1+(H_u-1)\Delta T)}{\text{minimize}} \; E(t) \\ &\text{subject to } \theta_{min} \le \theta(t) \le \theta_{max} \\ &\qquad \dot{\theta}_{min} \le \dot{\theta}(t) \le \dot{\theta}_{max} \\ &\qquad \ddot{\theta}_{min} \le M^{-1}\tau - M^{-1}C_o \le \ddot{\theta}_{max} \\ &\qquad G\dot{\theta} \le Q_{A_{max}} 1_{32\times 1} \\ &\qquad n_i \cdot p_L(t) = C_{i_L}\theta(t) + C_{tay_{i_L}} \ge -d_i \\ &\qquad n_i \cdot p_R(t) = C_{i_R}\theta(t) + C_{tay_{iR}} \ge -d_i \\ &\qquad (i = 1, 2, \ldots, n_p) \end{aligned} \tag{28}$$

τ(t) is a control input torque for a control plant and is a solution of the optimization operation. $H_u$ is a control horizon that determines how many steps ahead the inputs are to be handled in the optimization problem.

The command unit 58 outputs a control command to control the working equipment 1 on the basis of the amount of drive calculated by the prediction unit 562.

In the present embodiment, the prediction unit 562 calculates a predicted value of an operation amount in the functional range of each working member or hydraulic cylinder 10, on the basis of the target value and the prediction model of the working equipment 1.

In other words, the prediction unit 562 calculates a predicted value of the angle θ of each working member in the range of movement of the working member. The prediction unit 562 calculates a predicted value of the boom angle θ1 within the range of movement of the boom 6. The prediction unit 562 calculates a predicted value of the arm angle θ2 within the range of movement of the arm 7. The prediction unit 562 calculates a predicted value of the bucket angle θ3 within the range of movement of the bucket 8. The same applies to the tilt angle θ4 and the rotation angle θ5.

Furthermore, the prediction unit 562 predicts the hydraulic oil supply flow rate $Q_{wm}$ in the hydraulic oil supply range of each hydraulic cylinder 10. As described above, the hydraulic oil supply range defined for the hydraulic cylinder 10 is in the range between the minimum value $Q_{wm_min}$ and the maximum value $Q_{wm_max}$. The prediction unit 562 predicts the hydraulic oil supply flow rate $Q_{bm}$ in the hydraulic oil supply range of the boom cylinder 11. The prediction unit 562 predicts the hydraulic oil supply flow rate $Q_{ar}$ in the hydraulic oil supply range of the arm cylinder 12. The prediction unit 562 predicts the hydraulic oil supply flow rate $Q_{bk}$ in the hydraulic oil supply range of the bucket cylinder 13. The same applies to the tilt cylinder 14 and the rotating cylinder 15.

The determination unit 61 determines whether a first working member of the plurality of working members reaches a limit value of the functional range. As described above, the functional range of each working member includes the range of movement of the working member. The limit value of the functional range of the working member includes an end of the range of movement of the working member (an end of a stroke). In other words, the determination unit 61 determines whether the first working member approaches the end of the range of movement. The determination unit 61 is configured to determine whether the working member approaches the range of movement on the basis of detection data of the angle detection device 30. The approach of the working member to the end of the stroke, which is the end of the range of movement, represents that a difference between an actual angle of the working member (angle detected by the angle detection device 30) and a stroke end angle that indicates the end of the stroke of the working member is equal to or less than a predetermined threshold.

Furthermore, the determination unit 61 determines whether a first hydraulic cylinder 10 of the plurality of hydraulic cylinders 10 reaches the limit value of the functional range. As described above, the functional range of the hydraulic cylinder 10 includes the hydraulic oil supply range defined for the hydraulic cylinder 10. The limit value of the functional range of the hydraulic cylinder 10 includes the minimum value $Q_{wm_min}$ and the maximum value $Q_{wm_max}$ of the hydraulic oil supply range. In other words, the determination unit 61 determines whether the hydraulic oil supply flow rate $Q_{wm}$ for the first hydraulic cylinder 10 reaches the minimum value $Q_{wm_min}$ or the maximum value $Q_{wm_max}$ of the hydraulic oil supply range. The reaching of the hydraulic oil supply flow rate for each hydraulic cylinder 10 to a limit value of the hydraulic oil supply range represents that a difference between an actual measurement value of the hydraulic oil supply flow rate for the hydraulic cylinder 10 (hydraulic oil supply flow rate detected by a flow rate sensor which is not illustrated) and the limit value thereof is equal to or less than a predetermined threshold value.

When it is determined that the first working member is to reach the limit value of the functional range, the prediction unit 562 calculates an amount of drive to control an operation amount of a second working member so as to prevent the first working member from approaching the limit value of the functional range.

The prevention of the first working member from approaching the limit value of the functional range represents that when the determination unit 61 determines that a difference $\Delta\theta$ between the actual angle of the working member and the stroke end angle indicating the end of the stroke of the working member is equal to or less than the threshold value, the difference $\Delta\theta$ at the time at which the determination is made by the determination unit 61 is prevented from further decreasing.

When it is determined that the first working member approaches the end of the range of movement, the prediction unit 562 calculates the amount of drive to control an angle of the second working member so as to prevent the first working member from approaching the end of the range of movement. In an example, when it is determined that the first working member reaches the limit value of the functional range, the prediction unit 562 calculates the amount of drive to control the operation amount of the second working member so that the first working member has a median functional range. In other words, when it is determined that the first working member approaches the end of the range of movement, the prediction unit 562 calculates the amount of drive to control the angle of the second working member so as to prevent the first working member from approaching the end of the range of movement.

When it is determined that the first hydraulic cylinder 10 is to reach the limit value of the functional range, the prediction unit 562 calculates an amount of drive to control an operation amount of a second hydraulic cylinder 10 so as to prevent the first hydraulic cylinder from approaching the limit value of the functional range.

The prevention of the first hydraulic cylinder 10 from approaching the limit value of the functional range represents that when the determination unit 61 determines that a difference $\Delta Q$ between the actual measurement value of the hydraulic oil supply flow rate for the hydraulic cylinder 10 and the limit value thereof is equal to or less than the threshold value, the difference $\Delta Q$ at the time at which the determination is made by the determination unit 61 is prevented from further decreasing.

When it is determined that the first hydraulic cylinder 10 is to reach the limit value of the functional range, the prediction unit 562 calculates an amount of drive to control an operation amount of a second hydraulic cylinder 10 so as to prevent the first hydraulic cylinder from approaching the limit value of the functional range. In an example, when it is determined that the first hydraulic cylinder 10 is to reach the limit value of the functional range, the prediction unit 562 calculates an amount of drive to control an operation amount of a second hydraulic cylinder 10 so that the first hydraulic cylinder has a median functional range. In other words, when it is determined that a hydraulic oil supply flow rate $Q_{wm1}$ for the first hydraulic cylinder 10 reaches the minimum value $Q_{wm_min}$ or the maximum value $Q_{wm_max}$ of the hydraulic oil supply range, the prediction unit 562 calculates the amount of drive to control a hydraulic oil supply flow rate $Q_{wm_wm2}$ for the second hydraulic cylinder 10 so that the hydraulic oil supply flow rate $Q_{wm1}$ for the first hydraulic cylinder changes to a median hydraulic oil supply range $Q_{wm_mid}$.

Figure 9:
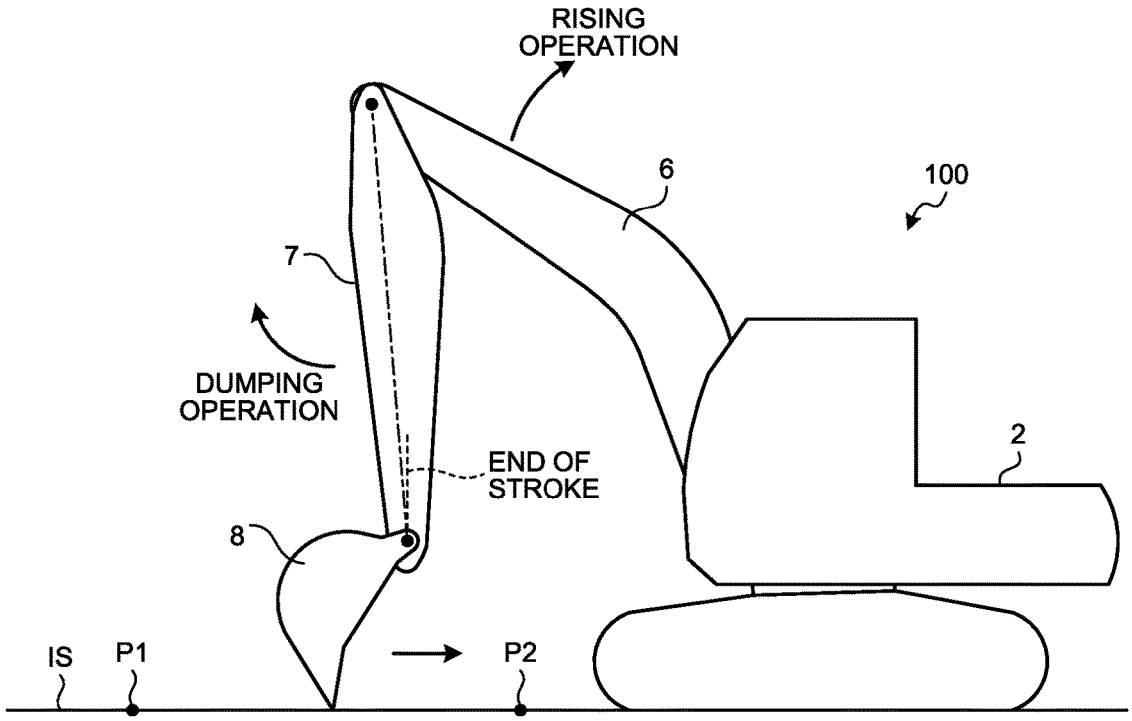
FIG. 9 is a diagram illustrating an example of an operation of the construction machine according to the present embodiment.

FIG. 9 is a diagram illustrating an example of an operation of the excavator 100 according to the present embodiment. With reference to FIG. 9, the example will be described in which when it is determined that the first working member approaches the end of the range of movement, the angle of the second working member is controlled so as to prevent the first working member from approaching the end of the range of movement. In the following description, it is assumed that the first working member is the bucket 8 and the second working member is one or both of the boom 6 and the arm 7.

The excavator 100 includes the swing body 2 configured to support the working equipment 1. The driver operates the operation device 40 to move the bucket 8 from a first position P1 of the design surface IS to a second position P2 that is closer to the swing body 2 than the first position P1. The model predictive control unit 56 calculates the predicted value of the position of the blade edge 9 on the basis of a target value of the position of the blade edge 9 of the working equipment 1 and the prediction model, and calculates the amount of drive to control the working equipment 1 so that the blade edge 9 follows the design surface IS on the basis of the predicted value. The command unit 58 controls the working equipment 1 on the basis of the amount of drive calculated by the model predictive control unit 56. When the operation device 40 is operated so that the bucket 8 moves from the first position P1 to the second position P2 of the design surface IS, the bucket 8 gradually approaches the end (the end of the stroke) of the range of movement of the bucket 8 as illustrated in FIG. 9.

When it is determined that the bucket 8 approaches the end of the range of movement by the determination unit 61 while the operation device 40 operating the working equipment 1 moves the bucket 8 from the first position P1 to the second position P2, the prediction unit 562 calculates the amount of drive to control the angle of one or both of the boom 6 and the arm 7 so as to prevent the bucket 8 from approaching the end of the range of movement. The command unit 58 controls the angle of one or both of the boom 6 and the arm 7 on the basis of the amount of drive calculated by the model predictive control unit 56. In the present embodiment, when the bucket 8 approaches the end of the range of movement, the command unit 58 operates the boom 6 to rise so as to prevent the bucket 8 from approaching the end of the range of movement. Note that when the bucket 8 approaches the end of the range of movement, the command unit 58 may operate the arm 7 to dump so as to prevent the bucket 8 from approaching the end of the range of movement. Therefore, when it is desired to move the bucket 8 from the first position P1 to the second position P2, the bucket 8 is inhibited from reaching the end of the stroke on the way. Therefore, the bucket 8 is allowed to move from the first position P1 to the second position P2. Therefore, it is possible to level the construction target between the first position P1 and the second position P2 by a single movement of the bucket 8.

As described above, with reference to FIG. 9, the example has been described in which when it is determined that the first working member approaches the end of the range of movement, the angle of the second working member is controlled so as to prevent the first working member from approaching the end of the range of movement. Next, an example will be described in which when it is determined that the hydraulic oil supply flow rate $Q_{wm1}$ for the first hydraulic cylinder 10 reaches the limit value (the minimum value $Q_{wm_min}$ or the maximum value $Q_{wm_max}$) of the hydraulic oil supply range, the hydraulic oil supply flow rate $Q_{wm2}$ for the second hydraulic cylinder 10 is controlled so that the hydraulic oil supply flow rate $Q_{wm1}$ for the first hydraulic cylinder 10 changes to the median hydraulic oil supply range $Q_{wm_mid}$. In the following description of the example, for the sake of simplicity, the flow rate of the hydraulic oil discharged from the hydraulic pump 17 is Q, and the hydraulic oil discharged from the hydraulic pump 17 is distributed to the boom cylinder 11, the arm cylinder 12, and the bucket cylinder 13. Therefore, the flow rate Q is a sum of the hydraulic oil supply flow rate $Q_{bm}$ for the boom cylinder 11, the hydraulic oil supply flow rate $Q_{ar}$ for the arm cylinder 12, and the hydraulic oil supply flow rate $Q_{bk}$ for the bucket cylinder 13 ($Q=Q_{bm}+Q_{ar}+Q_{bk}$)

For example, when it is determined that the hydraulic oil supply flow rate $Q_{bk}$ for the bucket cylinder 13 reaches the maximum value $Q_{bk_max}$, the prediction unit 562 calculates the amount of drive to control one or both of the hydraulic oil supply flow rate $Q_{bm}$ for the boom cylinder 11 and the hydraulic oil supply flow rate $Q_{ar}$ for the arm cylinder 12 so that the hydraulic oil supply flow rate $Q_{bk}$ for the bucket cylinder 13 changes to the median hydraulic oil supply range (so that the hydraulic oil supply flow rate $Q_{bk}$ is reduced). The command unit 58 outputs the control command to the valve device 18 on the basis of the amount of drive calculated by the prediction unit 562 so that one or both of the hydraulic oil supply flow rate $Q_{bm}$ for the boom cylinder 11 and the hydraulic oil supply flow rate $Q_{ar}$ for the arm cylinder 12 increase.

This makes it possible that a state in which only the bucket 8 operates at a high operating speed is shifted to a state in which the operating speed of the bucket 8 is lowered and one or both of the boom 6 and the arm 7 operate at a high operating speed.

[Control Method]

Figure 10:
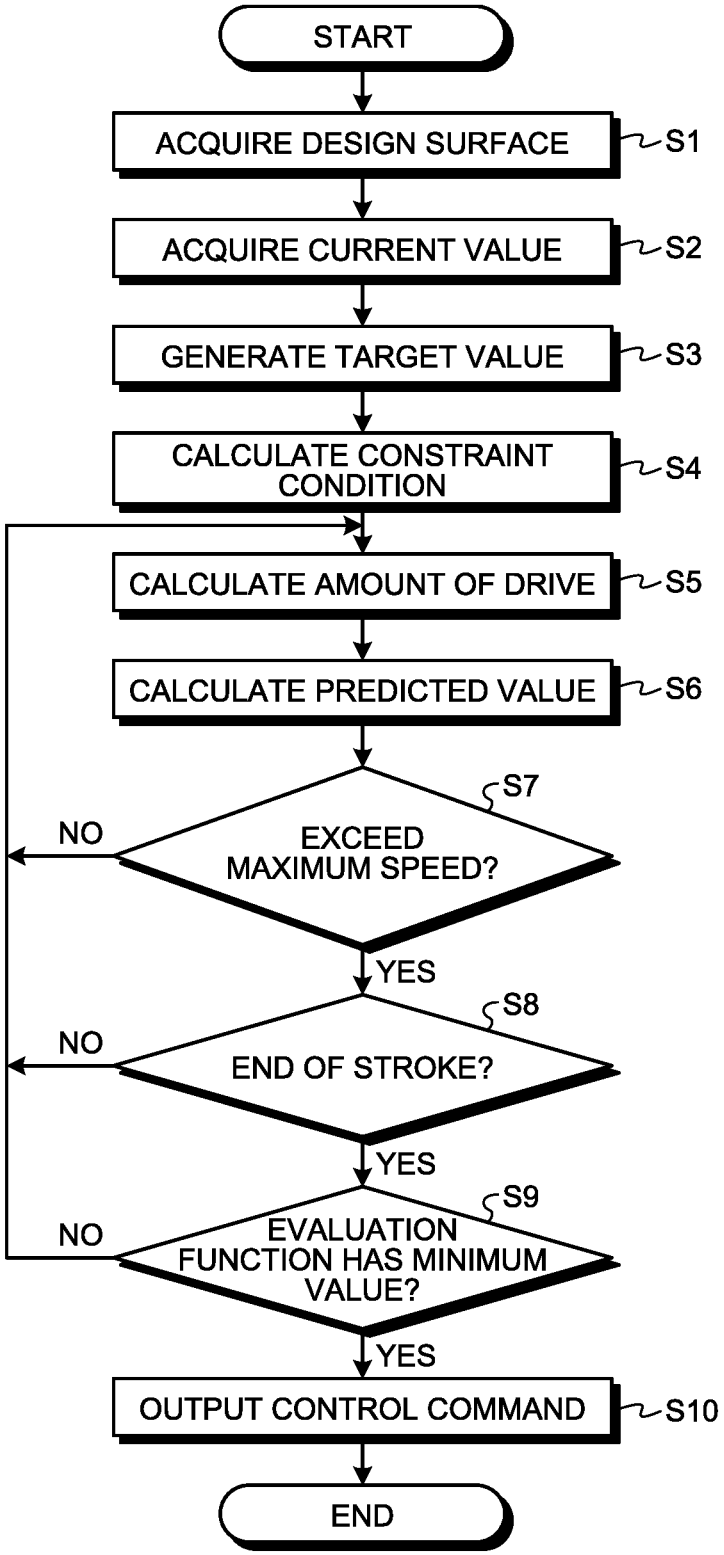
FIG. 10 is a flowchart illustrating a control method for the construction machine according to the present embodiment.

FIG. 10 is a flowchart illustrating a control method for the excavator 100 according to the present embodiment. In the present embodiment, the control method in the work such as moving the bucket 8 from the first position P1 to the second position P2 as described with reference to FIG. 9 will be described.

The design surface acquisition unit 54 acquires the design surface data (step S1).

The positional data acquisition unit 51 acquires the positional data of the swing body 2 from the position calculation device 20, as a current value. Furthermore, the angle data acquisition unit 52 acquires the angle data and angular speed data of the working equipment 1 from the angle detection device 30, as the current values (step S2).

The driver operates the operation device 40. The operation data acquisition unit 53 acquires the operation data from the operation device 40. The target value generation unit 55 generates the target value of the amount of control of the working equipment 1 on the basis of at least the operation data of the operation device 40 (step S3).

The target value of the amount of control of the working equipment 1 includes a target value of the moving speed of the bucket 8. The target value of the moving speed of the bucket 8 includes the target translational speed $v_{target}$ of the bucket 8, described with reference to FIG. 6, and the target rotation speed $\omega_{target}$ of the bucket 8, described with reference to FIG. 8. The target value generation unit 55 calculates the target value including the target translational speed $v_{target}$ and target rotation speed $\omega_{target}$ of the bucket 8, on the basis of the operation data of the operation device 40, the angle data indicating each angle θ of the working equipment 1 that changes by operating the operation device 40 and the angular speed data indicating the amount of change in each angle θ per unit time, and the design surface data.

The constraint condition calculation unit 57 calculates the first constraint condition relating to the performance of the excavator 100 and the second constraint condition relating to the position of the bucket 8, on the basis of the operation data of the operation device 40, the angle data indicating each angle θ of the working equipment 1 that changes by operating the operation device 40 and the angular speed data indicating the amount of change in each angle θ per unit time, and the design surface data (step S4).

The prediction unit 562 calculates the amount of drive to control the working equipment 1 so as to satisfy the constraint condition calculated in step S5, on the basis of the target value of the amount of control of the working equipment 1 and the prediction model stored in the prediction model storage unit 561 (step S5).

The prediction unit 562 calculates the amount of drive of the working equipment 1, for example, to ten steps ahead from the present time.

The prediction unit 562 calculates the predicted value of the amount of control of the working equipment 1 on the basis of the amount of drive calculated in step S6 and the current value acquired in step S3 (step S6).

The prediction unit 562 calculates the predicted value of the moving speed of the working equipment 1 and the predicted value of the position of the blade edge 9, for example, to ten steps ahead from the present time.

The prediction unit 562 determines whether a predicted value of a bucket speed that is calculated so that the blade edge 9 of the bucket 8 follows the design surface IS exceeds a maximum speed, on the basis of the operation data of the operation device 40 operating the working equipment 1 (step S7).

In step S7, if it is determined that the predicted value of the bucket speed does not exceed the maximum speed (step S7: No), the prediction unit 562 recalculates the amount of drive so that the predicted value of the amount of control follows the target value thereof (step S5).

The prediction unit 562 recalculates the amount of drive so as to minimize the value of the evaluation function defined by the target value and the current value of the amount of control. The prediction unit 562 recalculates the amount of drive so as to satisfy the first constraint condition and the second constraint condition.

In step S7, if it is determined that the predicted value of the bucket speed exceeds the maximum speed (step S7: Yes), the determination unit 61 determines whether the bucket 8 approaches the end of the stroke that is the end of the range of movement, on the basis of angle data of the bucket 8 acquired by the angle data acquisition unit 52 (step S8).

In step S8, if it is determined that the bucket 8 does not approach the end of the stroke (step S8: No), the boom 6 and the arm 7 are driven on the basis of the operation of the operation device 40.

In step S8, if it is determined that the bucket 8 approaches the end of the stroke (step S8: Yes), the prediction unit 562 recalculates the amount of drive for operating the boom 6 to rise so as to prevent the bucket 8 from approaching the end of the range of movement (step S5).

In step S8, if it is determined that the bucket 8 approaches the end of the stroke (step S8: Yes), the prediction unit 562 determines whether the evaluation function has the minimum value (step S9).

The speed of the bucket 8 may be the angular speed or angular acceleration of each axis of the working equipment 1 or swing body 2. The maximum speed may be an upper limit. In other words, in step S8, the prediction unit 562 may determine whether a predicted value of the angular acceleration of each axis exceeds the upper limit angular acceleration.

In step S9, if it is determined that the evaluation function does not have the minimum value (step S9: No), the prediction unit 562 recalculates the amount of drive so that the predicted value of the amount of control follows the target value (step S5).

The prediction unit 562 repeats the processing of step S5, step S6, step S7, step S8, and step S9 until the evaluation function has the minimum value.

In step S9, if it is determined that the evaluation function has the minimum value (step S9: Yes), the command unit 58 outputs the control command for control of the working equipment 1, on the basis of the amount of drive to control the working equipment 1 which is calculated in step S6 (step S10).

As described above, the amount of drive is calculated from the present time, for example, to ten steps ahead. The command unit 58 outputs, as the control command, the amount of drive having been calculated in the first step, from the amounts of drive having been calculated ten steps ahead.

Therefore, as described with reference to FIG. 9, the bucket 8 moving from the first position P1 to the second position P2 is inhibited from reaching the end of the stroke on the way. Therefore, the bucket 8 is allowed to move from the first position P1 to the second position P2. Therefore, it is possible to level the construction target between the first position P1 and the second position P2 by a single movement of the bucket 8.

[Effects]

As described above, according to the present embodiment, the model predictive control of the working equipment 1 makes it possible for the control device 50 to control the working equipment 1 so that the bucket 8 follows the design surface, regardless of the conditions of the construction site, which may change variously.

For example, as described above, when the bucket 8 is moved from the first position P1 to the second position P2 to level the construction target, the bucket 8 may reach the end of the stroke before the bucket 8 reaches the second position P2. This may make it impossible to level the ground with a single operation of the bucket 8. Furthermore, when the bucket 8 is forcibly moved to the second position P2, the bucket 8 may dig below the design surface.

In the present embodiment, even if design surfaces of various shapes are set at the construction site, or even if works of various contents are required at the construction site, the model predictive control of the working equipment 1 can cause the working equipment 1 to follow the design surfaces. Therefore, it is possible to construct the construction target into a desired shape while suppressing a decrease in work efficiency.

Figure 11:
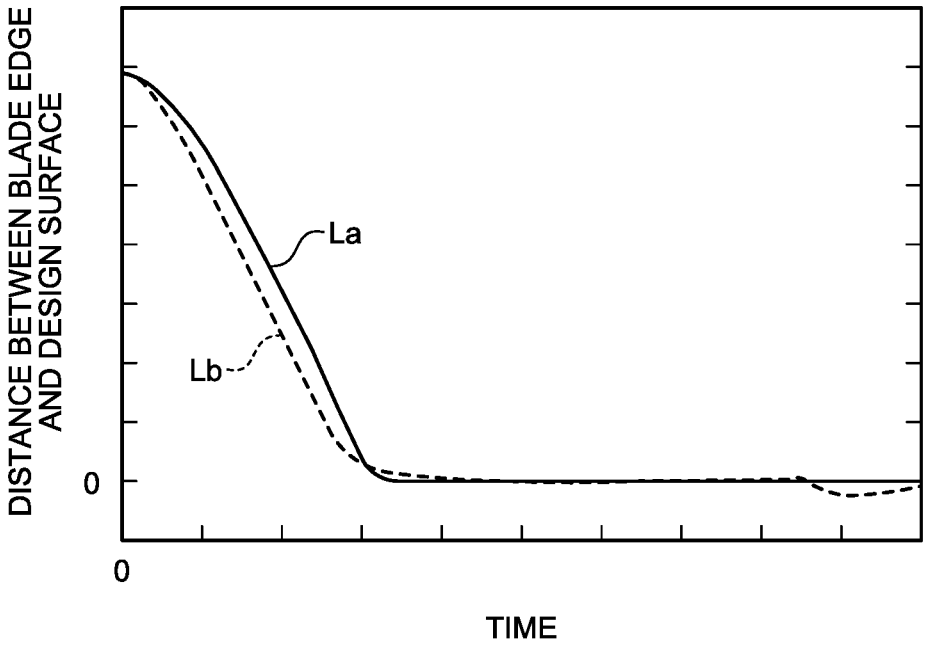
FIG. 11 is a graph illustrating a result of comparison between control of working equipment by the control method according to the present embodiment and control of the working equipment by a control method according to a comparative example.

FIG. 11 is a graph illustrating a result of comparison between control of the working equipment 1 by the control method according to the present embodiment and control of the working equipment 1 by a control method according to a comparative example. In the graph illustrated in FIG. 11, the horizontal axis represents time and the vertical axis represents distance between the blade edge and the design surface. FIG. 11 illustrates the distance between the blade edge and the design surface when the bucket 8 is moved from the first position P1 to the second position P2 as described with reference to FIG. 9.

In FIG. 11, a line La indicates the result of control of the working equipment 1 controlled by the control method according to the present embodiment, and a line Lb indicates the result of control of the working equipment 1 by the control method according to the comparative example. The control method according to the comparative example is a control method in which feedback control is performed merely on the basis of the angle data of the working equipment 1 without performing the model predictive control.

As illustrated in FIG. 11, the control method according to the present embodiment makes it possible for the bucket 8 to move along the design surface, from the first position P1 to the second position P2, without digging below the design surface.

Meanwhile, in the control method according to the comparative example, when the bucket 8 approaches the second position P2, the bucket 8 reaching the end of the stroke disables following the design surface IS, and thus, the bucket 8 digs below the design surface IS, preventing construction of the construction target into the desired shape.

As described above, according to the present embodiment, the model predictive control of the working equipment 1 makes it possible for the control device 50 to appropriately control the working equipment 1 so that the bucket 8 moves along the design surface.

[Computer System]

Figure 12:
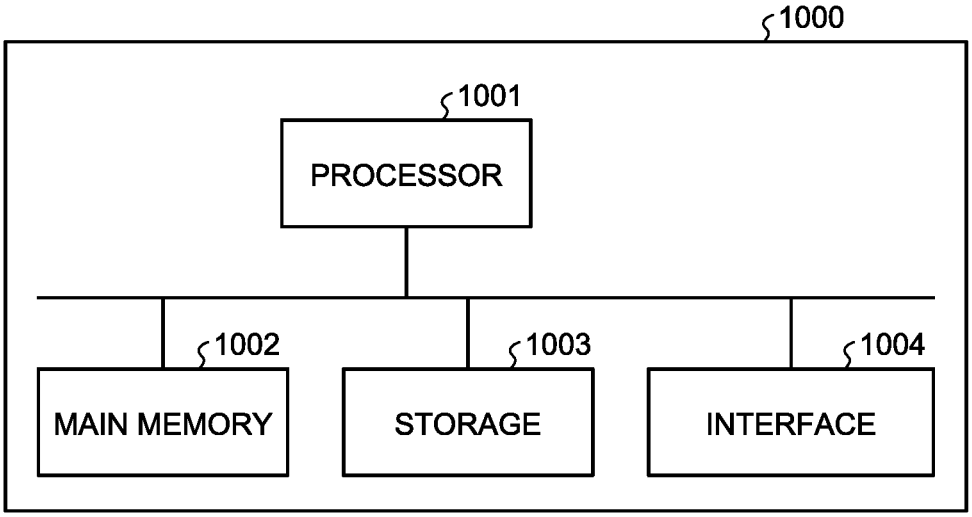
FIG. 12 is a block diagram illustrating an example of a computer system according to the present embodiment.

FIG. 12 is a block diagram illustrating an example of a computer system 1000 according to the present embodiment. The control device 50 described above includes the computer system 1000. The computer system 1000 includes a processor 1001 such as a central processing unit (CPU), a main memory 1002 that includes a nonvolatile memory such as a read only memory (ROM), and a volatile memory such as a random access memory (RAM), a storage 1003, and an interface 1004 that includes an input/output circuit. The functions of the control device 50 described above are stored, as programs, in the storage 1003. The processor 1001 reads a program from the storage 1003, loads the program in the main memory 1002, and executes the processing described above according to the program. Note that the programs may be distributed to the computer system 1000 via a network.

The computer system 1000 is configured to calculate the predicted value of the amount of control of the working equipment 1, on the basis of the target value of the amount of control of the working equipment 1 and the prediction model for the working equipment 1, calculate the amount of drive to control the working equipment 1, on the basis of the predicted value, and output the control command for control of the working equipment 1, on the basis of the amount of drive.

OTHER EMBODIMENTS

In the embodiments described above, the target value generation unit 55 is configured to employ the speed (translational speed and rotation speed) of the bucket 8 to generate the target value for the model predictive control unit 56. The target value generation unit 55 may employ the position and attitude of the bucket 8 to generate the target value for the model predictive control unit 56.

Note that in the embodiments described above, some or all of the functions of the control device 50 may be provided in an external computer system for the excavator 100. For example, the target value generation unit 55 and the model predictive control unit 56 may be provided in the external computer system so that the amount of drive calculated by the external computer system is transmitted to the excavator 100 via a wireless communication system.

Note that, in the embodiments described above, the construction machine 100 is the excavator. The component elements described in the above embodiments are applicable to a construction machine with working equipment, which is different from the excavator.

Note that in the embodiments described above, the swing motor 16 configured to swing the swing body 2 does not need to be the hydraulic motor. The swing motor 16 may be an electric motor configured to be driven by power supply. Furthermore, the working equipment 1 may be operated not by the hydraulic cylinder 10 but by power generated by an electric actuator such as an electric motor.

REFERENCE SIGNS LIST

1 WORKING EQUIPMENT
2 SWING BODY
3 TRAVELING BODY
3C TRACK
4 CAB
4S SEAT
5 ENGINE
6 BOOM
7 ARM
8 BUCKET
9 BLADE EDGE
10 HYDRAULIC CYLINDER
11 BOOM CYLINDER
12 ARM CYLINDER
13 BUCKET CYLINDER
14 TILT CYLINDER
15 ROTATING CYLINDER
16 SWING MOTOR
17 HYDRAULIC PUMP
18 VALVE DEVICE
20 POSITION CALCULATION DEVICE
21 POSITION CALCULATOR
22 ATTITUDE CALCULATOR
23 ORIENTATION CALCULATOR
30 ANGLE DETECTION DEVICE
31 BOOM ANGLE DETECTOR
32 ARM ANGLE DETECTOR
33 BUCKET ANGLE DETECTOR
34 TILT ANGLE DETECTOR
35 ROTATION ANGLE DETECTOR
40 OPERATION DEVICE
41 RIGHT OPERATING LEVER
42 LEFT OPERATING LEVER
43 TILT OPERATING LEVER
50 CONTROL DEVICE
51 POSITIONAL DATA ACQUISITION UNIT
52 ANGLE DATA ACQUISITION UNIT
53 OPERATION DATA ACQUISITION UNIT
54 DESIGN SURFACE ACQUISITION UNIT
55 TARGET VALUE GENERATION UNIT
56 MODEL PREDICTIVE CONTROL UNIT
57 CONSTRAINT CONDITION CALCULATION UNIT
58 COMMAND UNIT
60 STORAGE UNIT
61 DETERMINATION UNIT
70 DESIGN SURFACE DATA SUPPLY DEVICE
100 CONSTRUCTION MACHINE
200 CONTROL SYSTEM
551 TARGET TRANSLATIONAL SPEED CALCULATION UNIT
551A TRANSLATIONAL SPEED CALCULATION UNIT
551B SPEED LIMIT CALCULATION UNIT
551C PI CONTROL UNIT
551D DECELERATION PROCESSING UNIT
552 TARGET ROTATION SPEED CALCULATION UNIT
552A CURRENT ATTITUDE CALCULATION UNIT
552B TARGET ATTITUDE CALCULATION UNIT
552C ROTATION SPEED CALCULATION UNIT
552D P CONTROL UNIT
561 PREDICTION MODEL STORAGE UNIT
562 PREDICTION UNIT
AX1 BOOM AXIS
AX2 ARM AXIS
AX3 BUCKET AXIS
AX4 TILT AXIS
AX5 ROTATING AXIS

The invention claimed is:

1. A control system for a construction machine including working equipment including a plurality of devices relatively movable that have the same or similar functions, the control system comprising:

a processor configured to perform the following and configured with the following components:

a target value generation unit configured to generate a target value of an amount of control of the working equipment;

a prediction unit configured to calculate a predicted value of the amount of control of the working equipment based on the target value and a prediction model for the working equipment, and calculate an amount of drive to control the working equipment based on the predicted value; and a command unit configured to output a control command for control of the working equipment based on the amount of drive, calculating a predicted value of an operation amount of each of the devices in a functional range of the device, based on the target value and the prediction model;

determining whether a first device of the devices reaches a limit value of the functional range; and calculating an amount of drive to control the operation amount of a second device of the devices so as to prevent the first device of the devices from approaching the limit value of the functional range when it is determined that the first device of the devices is to reach the limit value of the functional range, wherein the first device includes a bucket, and the second device includes one or both of a boom and an arm.

2. The control system for the construction machine according to claim 1, wherein the construction machine includes a plurality of devices that have the same or similar functions, the prediction unit calculates a predicted value of an operation amount of each of the devices in a functional range of the device, based on the target value and the prediction model, the control system includes a determination unit configured to determine whether a first device of the devices reaches a limit value of the functional range, and the prediction unit calculates an amount of drive to control the operation amount of a second device of the devices so as to prevent the first device of the devices from approaching the limit value of the functional range when it is determined that the first device of the devices is to reach the limit value of the functional range.

3. The control system for the construction machine according to claim 2, wherein the working equipment includes a plurality of working members relatively movable, the device includes the working members, and the functional range includes a range of movement of each of the working members.

4. The control system for the construction machine according to claim 2, wherein the construction machine includes a plurality of hydraulic actuators, the devices include the hydraulic actuators, and the functional range includes a hydraulic oil supply range defined for each of the hydraulic actuators.

5. The control system for the construction machine according to claim 1, wherein the working equipment includes a plurality of working members relatively movable, the prediction unit calculates a predicted value of an angle of each of the working members in a range of movement of the working member, based on the target value and the prediction model, the control system includes a determination unit configured to determine whether a first working member of the working members approaches an end of the range of movement, and the prediction unit calculates an amount of drive to control an angle of a second working member of the working members so as to prevent the first working member of the working members from approaching the end of the range of movement when it is determined that the first working member of the working members approaches the end of the range of movement.

6. The control system for the construction machine according to claim 5, wherein the working equipment includes a boom, an arm, and a bucket, the first working member of the working members includes the bucket, the second working member of the working members includes one or both of the boom and the arm, the construction machine includes a swing body configured to support the working equipment, and the prediction unit calculates an amount of drive to control an angle of one or both of the boom and the arm so as to prevent the bucket from approaching the end of the range of movement when it is determined that the bucket approaches the end of the range of movement while the bucket is moved from a first position to a second position that is closer to the swing body than the first position by an operation device configured to operate the working equipment.

7. The control system for the construction machine according to claim 5, wherein the construction machine includes a plurality of hydraulic actuators configured to operate a plurality of the working members, respectively, the prediction unit calculates a predicted value of a hydraulic oil supply flow rate for each of the hydraulic actuators in a hydraulic oil supply range defined for the hydraulic actuator, based on the target value and the prediction model, the control system includes a determination unit configured to determine whether a hydraulic oil supply flow rate for a first hydraulic actuator of the hydraulic actuators reaches a limit value of the hydraulic oil supply range, and the prediction unit calculates an amount of drive to control a hydraulic oil supply flow rate for a second hydraulic actuator of the hydraulic actuators so as to prevent a hydraulic oil supply flow rate for a first hydraulic actuator of the hydraulic actuators from approaching the limit value of the hydraulic oil supply range when it is determined that the hydraulic oil supply flow rate for the first hydraulic actuator is to reach the limit value of the hydraulic oil supply range.

8. The control system for the construction machine according to claim 1, comprising an operation data acquisition unit configured to acquire operation data of an operation device configured to operate the working equipment, wherein the target value generation unit generates the target value based on the operation data.

9. The control system for the construction machine according to claim 1, comprising a design surface acquisition unit configured to acquire a design surface that indicates a target shape of a construction target, wherein the amount of control includes a position of a predetermined portion of the working equipment, and the prediction unit calculates the amount of drive such that a distance between a predetermined portion of the working equipment and the design surface is maintained, based on the predicted value and the design surface.

10. The control system for the construction machine according to claim 1, wherein the amount of control includes a moving speed of the working equipment.

11. The control system for the construction machine according to claim 1, wherein the prediction unit calculates the amount of drive such that the predicted value of the amount of control follows the target value.

12. The control system for the construction machine according to claim 1, wherein the prediction unit calculates the amount of drive such that a value of an evaluation function defined by the target value and predicted value of the amount of control is minimized.

13. The control system for the construction machine according to claim 12, comprising a constraint condition calculation unit configured to calculate a first constraint condition relating to performance of the construction machine and a second constraint condition relating to a position of the working equipment, wherein the prediction unit calculates the amount of drive so as to satisfy the first constraint condition and the second constraint condition.

14. A construction machine comprising:

a swing body configured to support the working equipment; and the control system for the construction machine according to claim 1.

15. A control method for a construction machine including a working equipment, comprising:

providing a processor configured to perform the following:

calculating a predicted value of an amount of control of the working equipment based on a target value of the amount of control of the working equipment and a prediction model for the working equipment;

calculating an amount of drive to control the working equipment based on the predicted value; and outputting a control command for control of the working equipment based on the amount of drive, calculating a predicted value of an operation amount of each of the devices in a functional range of the device, based on the target value and the prediction model;

determining whether a first device of the devices reaches a limit value of the functional range; and calculating an amount of drive to control the operation amount of a second device of the devices so as to prevent the first device of the devices from approaching the limit value of the functional range when it is determined that the first device of the devices is to reach the limit value of the functional range, wherein the first device includes a bucket, and the second device includes one or both of a boom and an arm.

* * * * *